United States Patent [19]

Vann et al.

[11] Patent Number: 4,564,076

[45] Date of Patent: Jan. 14, 1986

[54] WELL COMPLETION METHOD AND APPARATUS

[75] Inventors: Roy R. Vann, Katy, Tex.; Emmet F. Brieger, Nogal, N. Mex.

[73] Assignee: GEO Vann, Inc., Houston, Tex.

[21] Appl. No.: 483,478

[22] Filed: Apr. 11, 1983

[51] Int. Cl.[4] ..... E21B 43/185

[52] U.S. Cl. ..... 175/4.52; 175/4.54; 166/55.1; 166/297

[58] Field of Search ..... 175/4.52, 4.58, 4.56, 175/2, 4.54; 166/55, 55.1, 63, 242, 297; 102/223, 322; 89/1 C

[56] References Cited

U.S. PATENT DOCUMENTS

| | | | |
|---|---|---|---|
| 2,125,487 | 8/1938 | Church | 175/4.58 |
| 2,304,408 | 12/1942 | Holifield | 175/4.56 |
| 2,381,929 | 8/1945 | Schlumberger | 166/55.1 |
| 3,011,551 | 12/1961 | Young et al. | 175/4.52 |
| 3,040,808 | 6/1962 | Schramm et al. | 175/4.52 |
| 3,189,094 | 6/1965 | Hyde | 175/4.52 |
| 3,215,074 | 11/1965 | Robinson, Jr. et al. | 175/4.6 |
| 4,484,632 | 11/1984 | Vann | 166/297 |

OTHER PUBLICATIONS

"Flopelrol Johnston Tubing Conveyed Perforating Systems", Schlumberger, Jul.-1983.

*Primary Examiner*—James A. Leppink
*Assistant Examiner*—Hoang C. Dang

[57] ABSTRACT

A pipe string with a valve, pressure responsive member, packer, firing mechanism and perforating gun are suspended within a well to complete the well. The packer is set to form an upper and lower annulus, and the valve and pressure responsive member are disposed above the packer in the upper annulus. A signal transmission member extends from the pressure responsive member to the firing mechanism in the lower annulus. The valve is initially closed to prevent fluid flow through the flow bore of the pipe string. The upper annulus is pressurized to open the valve and create a pressure differential across the pressure responsive member. The pressure responsive member then transmits a signal through the signal transmission member to the firing mechanism to actuate the firing mechanism and detonate the perforating gun. Hydrocarbons from the formation then flow through the perforations and up the flow bore of the pipe string to the surface.

32 Claims, 21 Drawing Figures

WELL COMPLETION METHOD AND APPARATUS

BACKGROUND OF THE INVENTION

This invention relates to apparatus and methods for use in oil and/or gas wells or the like and more particularly to apparatus and methods for testing a hydrocarbon producing formation and/or completing one or more hydrocarbon producing formations.

One method for testing a formation in a cased well includes running an electric line casing gun perforator in mud of sufficient weight to control the well pressure, perforating the casing adjacent the zone to be tested, and then withdrawing the perforating gun. Test tools are then run into the well on a pipe string with well pressure being controlled with casing fluid of appropriate weight. A packer is set to close the annulus and a valve is opened in the pipe string to permit fluids from the formation to flow through the pipe string to the surface.

Another method for testing a formation includes running a tool string on drill pipe into the cased borehole with the tool string including full opening test tools with a full opening valve, and a packer disposed on the tool string for packing off the annulus. The casing adjacent the zone to be tested is packed off with the packer and the full opening valve is then opened providing fluid communication between the flow bore of the tubing string and the lower packed off portion of the casing. A small through-tubing perforating gun is lowered on an electric line through the test tools, and the casing adjacent the zone is perforated. The wireline perforating gun is then lubricated out of the well. Although additional through-tubing perforating guns can be lowered into the well to cover zones with long intervals, only the first perforation can be done with an underbalance so as to provide a negative pressure towards the tubing flow bore from the formation.

The latter method is particularly troublesome in high temperature wells where the mud contains solids such as barite. When the valve opens and pressure is removed from the mud below the valve, the water boils causing the barite to harden in the string below the valve. This can prevent through-tubing perforating guns from passing through the tool string.

Another method is disclosed in the Halliburton U.S. Pat. No. 2,169,559. In Halliburton, a formation tester, sub, packer, perforated pipe, perforating gun, and bull plug are all suspended on the end of a drill pipe string. The formation tester includes a limited opening valve and mandrel for opening the valve. The valve includes a depending rod extending through a gland located in the sub. Adjacent the gland are a number of passageways to permit fluid flow from a point beneath the sub and into the formation tester. The sub also includes a switch contact connected to a battery with an electrical conductor which extends downwardly through the packer and is connected to the perforating gun. The bull plug below the perforating gun may include a pressure recording apparatus. In operation, the packer is set to seal the lower portion of the well from the portion above the packer and the drill pipe is rotated and lowered causing the mandrel to open the valve in the formation tester. This automatically starts the firing of the gun since as the valve stem moves downwardly to unseat, the depending rod makes electrical contact with the electrical conductor in the sub to detonate the perforating gun. Any fluid in the formation then flows through the perforations and through the perforated pipe above the perforating gun. This fluid must then pass through the limited openings of the passageways in the sub and of the valve and into the drill pipe. After a sufficient length of time the drill pipe is raised thus lifting the mandrel off the valve stem to allow the valve to close. When the valve closes, a sample of the fluid from the formation is entrapped in the drill pipe. The packer is then released and the entire assembly is removed from the well with the entrapped sample.

As is now well known in the art of completing oil and/or gas wells, a perforating gun is lowered into the cased borehole and the well is perforated by shooting perforations through the casing, cement and into the hydrocarbon formation to permit the hydrocarbons to flow into the cased borehole and up to the surface. U.S. Pat. No. 3,706,344 to Vann discloses suspending a packer and perforating gun on a tubing string, setting the packer to isolate the production zone, releasing the trapped pressure below the packer by opening the tubing string to fluid flow, actuating the perforating gun through the tubing string, and immediately producing the well through the tubing string upon perforation. One means for actuating the perforating gun includes dropping a bar through the tubing string to impact the firing head of the perforating gun. U.S. Pat. No. 3,706,344 also discloses in FIG. 14 a firing head having a reciprocably mounted shaft for engaging the firing pin of the perforating gun. To detonate the gun, a member is lowered into the well on a slickline to engage and attach to the upper end of the shaft. As tension is applied to the slickline, the shaft is withdrawn from the firing head thereby compressing a spring abutting a lower portion of the shaft. A shear pin is then sheared by the upward movement of the shaft and the compression of the spring whereby the lower portion of the shaft accelerates toward and contacts the firing pin to detonate the gun.

After a borehole has been drilled into the ground and the casing cemented into position, well fluids fill the cased borehole with drilling mud and debris. The mud and debris gravitate towards the lower end of the cased borehole and tend to densify and congeal into a heavy layer of material. Such drilling mud and debris also will settle and congeal in the tubing string and collect around the firing head of the perforating gun. Further, other debris inside the tubing string such as flakes, rust, sand, scale and other material dropped into well from the surface, tend to collect in the bottom of the string. Often such debris becomes dislodged and falls down through the tubing string as the string is handled and lowered into the well. Again, these heavy particles and other suspended matter will gravitate to the bottom of the string where such contaminants densify into a heavy layer of material around the firing head.

In a perforating gun having a bar actuated gun firing head for example, it is possible for such contaminants to densify and collect about the gun firing head mechanism and become so compacted and viscous that the gun firing head cannot be sufficiently impacted to detonate the perforating gun. If the bar is unable to sufficiently strike the firing mechanism, the gun will not be detonated. The problem of debris and contamination is compounded when the string is left downhole for a substantial length of time.

The present invention overcomes these deficiencies as hereinafter described.

SUMMARY OF THE INVENTION

The method and apparatus of the present invention includes testing a hydrocarbon-containing formation located downhole in a borehole, by running formation test tools and a perforating gun apparatus downhole on the end of a pipe string in a single trip into the well. The formation test tools include either a full opening or non-full opening valve, and appropriate pressure-temperature instruments. The perforating gun apparatus includes a firing mechanism with flow ports opening into the lower annulus and a casing type perforating gun. The firing head preferably includes a pressure responsive means disposed in the pipe string above the packer and a firing mechanism adjacent the perforating gun whereby upon creating a pressure differential between the upper borehole annulus above the packer and the tubing flow bore and applying that pressure differential across the pressure responsive means, the pressure responsive means transmits a signal to the firing mechanism which activates the firing mechanism to detonate the perforating gun.

Accordingly, a primary object of the present invention is the provision of a method and apparatus for testing the formation in a single trip into the well with the test tools and perforating gun.

Another object of the present invention is the provision of a perforating gun of the casing type to achieve deeply penetrating perforations into the formation.

Still a further object of this invention is the provision of a method and apparatus for testing the formation with an underbalance which will produce high backsurge pressures and maximum flow.

Another and still further object of the present invention is the actuation of the perforating gun without the necessity of pressuring down the flow bore of the pipe string.

An additional object of the present invention is the provision of a method and apparatus which will permit the lowering of formation test tools and perforating guns in a single trip into the well and still use non-full opening test tools.

A further object of this invention is the provision of a system for detonating the perforating gun which does not require the lowering of a tool such as a bar, through the pipe string which might not reach the bottom due to mud, debris, or other contamination.

Another object of the method and apparatus of the present invention is to improve test results on the samples taken from the test formation.

An additional object of the present invention is the improvement in shot detection through the elimination of unnecessary noise such as that caused by the dropping of a bar through the pipe string.

A further object of the present invention is the elimination of the need for heavy mud to insure the well is killed since the perforating gun is suspended on the end of a tool string having a packer.

Still another object of the present invention is the elimination of running a wireline casing gun into the well and running a string into the well to pressure test the packer.

Another object of the present invention is the provision of a method and apparatus by which a payzone located downhole adjacent to the borehole can be tested in a safe and dependable manner.

These and various other objects and advantages of the invention will become readily apparent to those skilled in the art upon reading the following detailed description and claims and by referring to the accompanying drawings.

The above objects are attained im accordance with the present invention by the provision of a method for use with apparatus fabricated in a manner substantially as described in the above summary.

Other objects and advantages of the invention will appear from the following description.

BRIEF DESCRIPTION OF THE DRAWINGS

For a detailed description of the embodiments of the apparatus and methods of the present invention, reference will now be made to the accompanying drawings wherein.

DESCRIPTION OF THE PREFERRED EMBODIMENT

Figure 1:
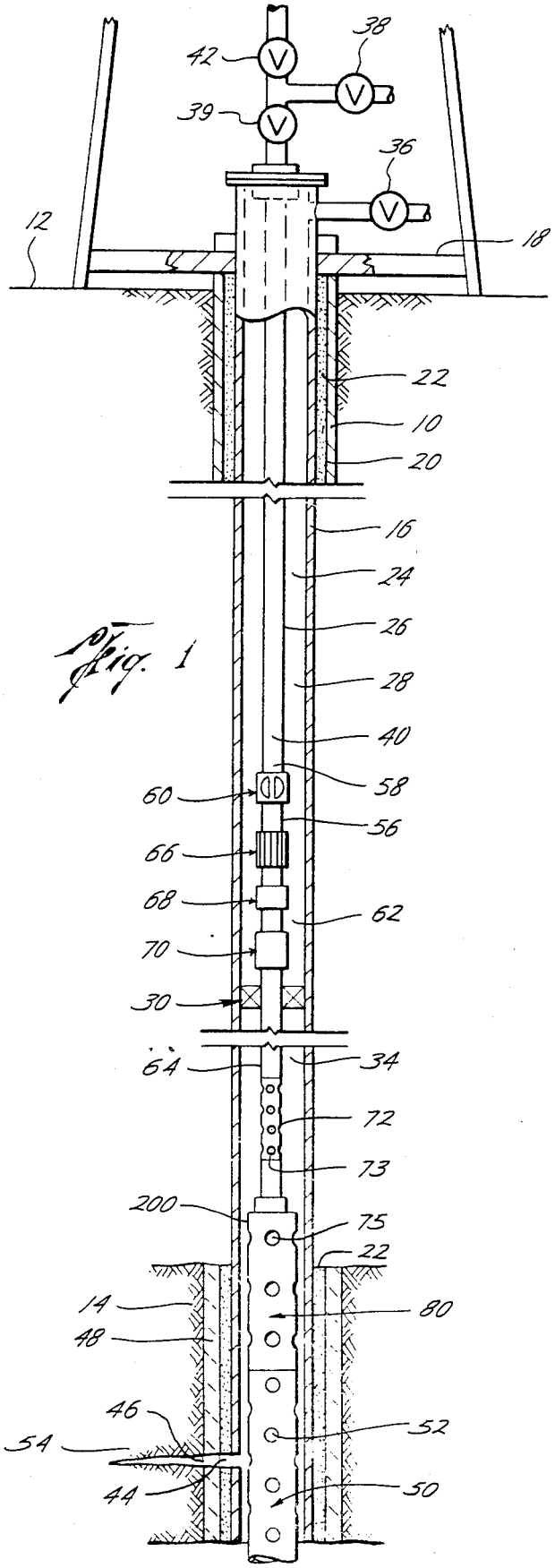
FIG. 1 is a fragmentary, part cross-sectional view of a borehole having apparatus made in accordance with the present invention for testing a formation.

Referring initially to FIG. 1, there is disclosed a borehole 10 extending downhole from the surface 12 of the ground through a hydrocarbon-containing formation 14. The borehole 10 is cased by a string of casing 16 hung from the floor of rig 18 and within surface casing 20. Casing string 16 is cemented into borehole 10 and casing 20 as shown at 22 and set in a casing hanger. Casing 16 isolates the wellbore 24 from formation 14. A string of production tubing 26 is suspended from rig 18 and extends from the surface 12 axially through casing 16. Tubing 26 within casing 16 forms borehole annulus 28, and packer 30, disposed on tubing 26, divides the borehole annulus 28 into an upper annulus 32 and a lower annulus 34. Suitable outlets are provided at the rig 18 for the tubing flow bore and each annulus formed by adjacent casing strings with each of the outlets being provided with suitable valves and the like, including valve 36 for the outlet communicating with the borehole annulus 28 and valves 38, 39 for the outlet communicating with the flow bore 40 of tubing string 26. A lubricator 42 is provided for access to tubing flow bore 40 for the use of slick line tools.

In order to complete the well or test the formation, it is necessary to access the hydrocarbons in formation 14 with the wellbore 24. This is accomplished by supporting a perforating gun 50 at the lower end of the tubing string 26. Gun 50 is preferably a jet casing gun, but it should be understood that the term is intended to include any means for communicating the hydrocarbon-producing formation 14 with lower annulus 34. The jet perforating gun of the casing type shoots metallic particles into the formation 14 to form perforations 44 and corresponding channels or tunnels 46. Numerals 44 and 46 broadly indicate one of a plurality of perforations and tunnels which are formed when the charges 52 of gun 50 are detonated. Perforating objectives include perforations of a desired size and configuration, prevention of further formation invasion and contamination during the perforating process, and maximum capacity to move the hydrocarbons from formation 14 to lower annulus 34.

During the drilling of the borehole 10, the formation pressures are controlled by weighted drilling fluid, filtrate and perhaps fines which invade the formation, interacting with in situ solids and fluids to create a contaminated zone 48, reducing permeability, and leaving on the face of formation 14 a low-permeability filter cake. The cementing operation also includes fluids and fines which invade and damage the formation 14 at the contaminated zone 48. Thus, the jet perforating gun 50 of the casing type using shaped charges 52 must penetrate deeply into the formation 14 to form tunnels 46 that pass through casing 16, cement 22, and contaminated zone 48 and into the uncontaminated or sterile zone 54 of formation 14. Perforations 44 and tunnels 46 form the final passageways which enable the hydrocarbons to flow from the formation 14, through tunnels 46 and perforations 44 and into lower annulus 34 for movement to the surface 12.

Various tool strings may be included with tubing string 26, packer 30, and gun 50 to complete the well and/or test the formation. FIG. 1 illustrates one variation of a tool string to test or sample the hydrocarbons contained in formation 14. As shown, the tool string includes tubing string 26, a valve 60, pressure-temperature instruments 66, a safety joint 68, a pressure responsive means 70, packer 30, a perforated nipple 72 having a plurality of flow ports 73, a firing mechanism 80 and casing perforating gun 50. Although the method of operation will be hereinafter set forth in greater detail, briefly, formation 14, is tested by setting packer 30, pressurizing upper annulus 32 to open valve 60 and activate pressure responsive means 70, cocking and firing mechanism 80 through the activation of pressure responsive means 70, detonating gun 50, perforating formation 14 and flowing hydrocarbons into the lower annulus 34, through flow ports 73, and up tubing flow bore 40 to the outlet 38.

Pressure-temperature instruments 66 are series connected in tubing string 26 to record subsurface well pressures and temperatures throughout the formation test. Such instruments may include the B.T. (Bourdon tube) pressure recorder and/or temperature recorder manufactured by Halliburton and described at pages 3991-2 of the 1982-83 Composite Catalog of Oilfield Equipment and Services.

Valve 60 may be of various types used for formation testing and may be actuated by hydraulic pressure, reciprocation or rotation. Common hydraulically actuated valves are the PCT (Pressure-Controlled Test) valves manufactured by Johnston-Macco of Schlumberger and the APR (Annulus Pressure Responsive) valves manufactured by Halliburton described at pages 4986 and 4003-4, respectively, of the 1982-83 *Composite Catalog of Oilfield Equipment and Services.* The Johnston PCT sleeve valve uses annular pump pressure to open the valve and hold it open. When the annulus pressure is bled off, a coil spring and nitrogen pressure in the valve automatically closes the valve.

Safety joint 68 is used in instances where downhole tools have become stuck due to hole sloughing, cavings or similar conditions and may be of the type manufactured by Halliburton and described at page 3999 of the 1982-83 *Composite Catalog of Oilfield Equipment and Services.*

Packer 30 may be of various types but preferably is a hook wall packer such as the Halliburton RTTS hook wall packer described at page 3997 of the 1982-83 *Composite Catalog of Oilfield Equipment and Services.* Packer 30 could also be a hydraulically-set packer or a permanent packer.

Flow ports 73 may be in any member below packer 30 and valve 60 to facilitate flow betwen lower borehole annulus 34 and tubing flow bore 40. As shown in FIG. 1, flow ports 73 are disposed in perforated nipple 72 and could also be disposed in firing mechanism 80.

EMBODIMENT OF FIGS. 2-6

Referring now to the drawings in detail and first to FIGS. 2-6, FIGS. 2A and 2B depict pressure responsive means 70 which is series connected in tubing string 26 above packer 30 of FIG. 1. Pressure responsive means 70 of this embodiment includes an annular chamber 74, piston means 76, pressure communication means 78 and force transmission means 82.

Pressure responsive means 70 includes a tubular body 84 having a cylinder 86 and mandrel 88. Mandrel 88 has a lower enlarged diameter portion 90, a threaded medial portion 92, and an upper reduced diameter tubular portion 94. Cylinder 86 telescopingly receives tubular portion 94 and has threads at its lower end for threading engagement at 96 with medial portion 92 of mandrel 88. Set screws 98 threadingly extend through tapped bores in the lower end of cylinder 86 to engage the bottom of a groove 100 around medial portion 92 adjacent shoulder 102 formed by portions 90 and 92. The lower end of cylinder 86 engages shoulder 102.

Means for making rotary shouldered connections with adjacent drill pipe members 104, 106 are provided at the upper end of cylinder 86 and lower end of mandrel 88, e.g. a tapered threaded pin 108 and shoulder 110 at the bottom and a correlative threaded box 112 with shoulder 114 at the top. Thus, threaded box 112 threadingly receives the pin end of upper drill pipe member 104 and the threaded pin 108 is inserted into the box end of lower drill pipe member 106. Drill pipe member 106 is the upper member of drill pipe string 64 extending from pressure responsive means 70 to firing mechanism 80. Rotary shouldered connections are provided since the rig operator generally uses the pipe readily available at the well site. Since that pipe, such as members 104, 106, is often drill pipe or drill collars, the connections on tubular body 84 must have rotary shouldered connections to be compatible.

Piston means 76 includes a piston sleeve 116 dimensioned to be received in the annular space 118 formed between cylinder 86 and tubular portion 94 of mandrel 88. Sleeve 116 has an enlarged lower end 120 which is slidably mounted within annular space 118 and a reduced inner and outer diameter upper end 122 having clearance with the walls 124, 126 of tubular portion 94 and cylinder 86 respectively. Upper end 122 of sleeve 116 extends upwardly beyond the free end of tubular portion 94 and out of annular space 118. Inner and outer O-rings 128, 130 respectively, are housed in annular grooves in the inner and outer peripheral surfaces of piston sleeve 116 for sealingly engaging the walls 124, 126 of tubular portion 94 and cylinder 86 respectively.

Annular pressure chamber 74 is that lower portion of annular space 118 between the lower end 132 of piston sleeve 116 and shoulder 134 formed by tubular portion 94 and medial portion 92. Piston sleeve 116 and tubular portion 94 have cooperating annular shoulders at 136 to limit the downward movement of sleeve 116 within annular space 118.

Pressure communication means 78 includes a plurality of ports 140 extending radially through the lower end of cylinder 86 above threads 96. Ports 140 provide fluid communication between upper borehole annulus 32 and pressure chamber 74. Thus, the fluid pressure of upper borehole annulus 32 is applied to the lower end 132 of piston sleeve 116. Shear pins 138 extend through apertures in the lower end of sleeve 116 and into blind bores in tubular portion 94 below shoulders 136. Shear pins 138 prevent the upward movement of piston sleeve 116 in annular space 118 until a predetermined pressure differential is applied across piston sleeve 116 which is sufficient to shear pins 138, as will be more fully described hereinafter.

Force transmission means 82 in this embodiment includes a cable 142 extending from pressure responsive means 70 to firing mechanism 80, attachment means 144 for attaching the upper end of cable 142 to piston means 76, biasing means 146 for biasing attachment means 144 in the direction of the firing mechanism 80, and connection means 256, hereinafter described, for attaching the lower end of cable 142 to firing mechanism 80.

Figure 2A:
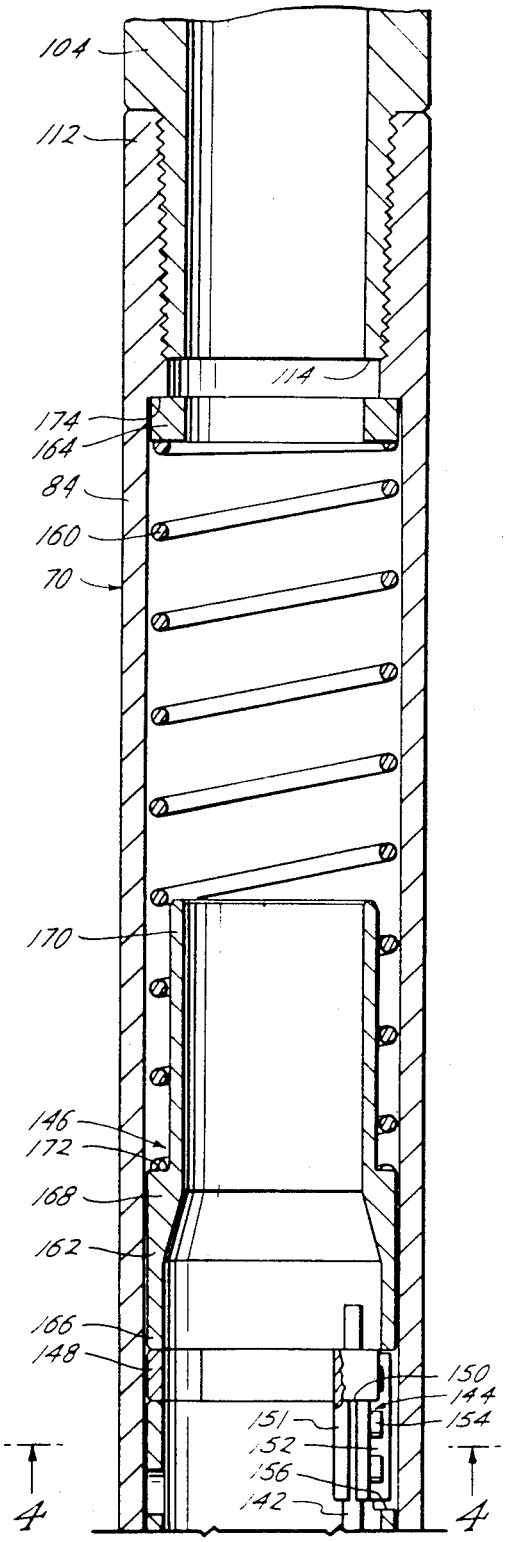
FIGS. 2A and 2B are enlarged cross-sectional views of the pressure responsive means of the apparatus shown in FIG. 1.
Figure 2B:
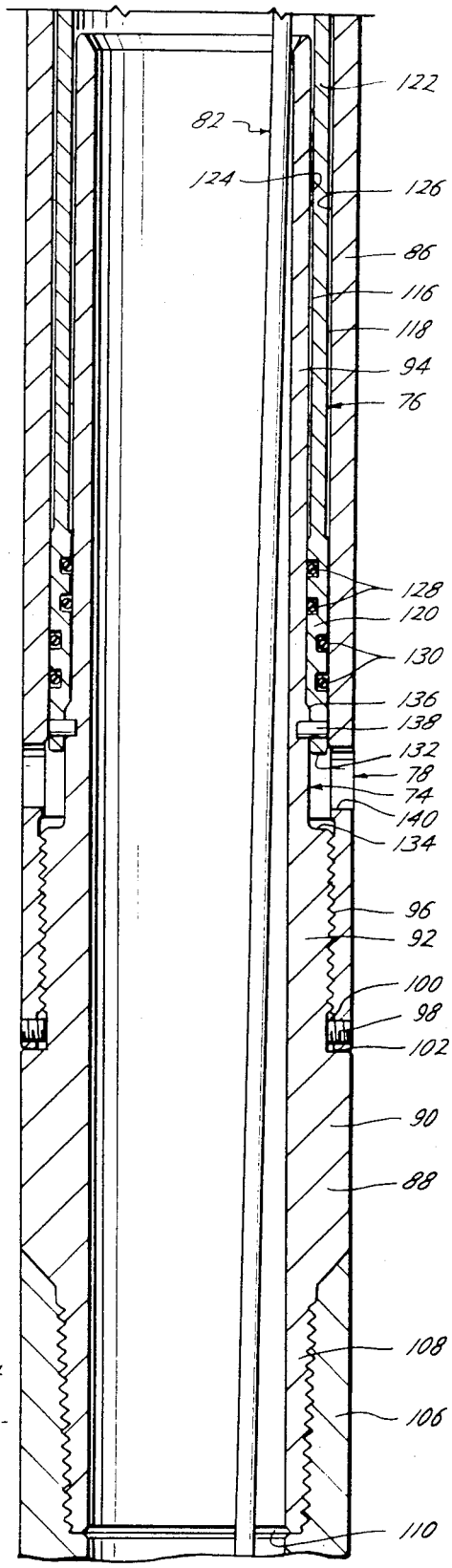
Figure 4:
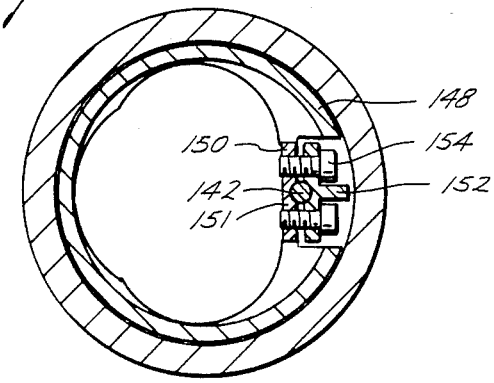
FIG. 4 is a cross-sectional view of the pressure responsive means of FIG. 2 taken at plane 4—4 in FIG. 2.

Referring now to both FIGS. 2A, 2B and 4 illustrating attachment means 144, means 144 includes a ring 148 disposed on top of piston sleeve 116, and clamp 150 extending downwardly from ring 148. Clamp 150 includes a vertical plate 151 affixed to ring 148 and a T-plate 152 with screws 154 for threading engagement with vertical plate 151 to clamp cable 142 to ring 148. A vertical slot 156 is provided in the upper end of piston sleeve 116 to receive the downwardly extending portion of clamp 150. The open area through ring 148 with clamp 150, best shown in FIG. 4, is equivalent to that of the flow bore. Thus, there is no flow restriction through attachment means 144.

Biasing means 146 includes a spring 160 with a tubular retainer 162 at the bottom and a stop ring 164 at the top. Tubular retainer 162 has a lower tubular portion 166, a transition portion 168 and an upper reduced outer diameter portion 170. Transition portion 168 and upper portion 170 form a bearing shoulder 172 for engagement with one end of spring 160 as spring 160 is telescopingly received over upper reduced outer diameter portion 170. Stop ring 164 is disposed between the upper end of spring 160 and opposing shoulder 174 formed at the box end 112 of cylinder 86. As the assembly of piston means 76 and force transmission means 82 move toward shoulder 174, spring 160 is compressed within cylinder 86.

A weight may be removably affixed to the lower end of cable 142, such as by set screws, for stringing cable 142 down through drill pipe string 64 to facilitate the connection of the lower end of cable 142 to firing mechanism 80.

Figure 3A:
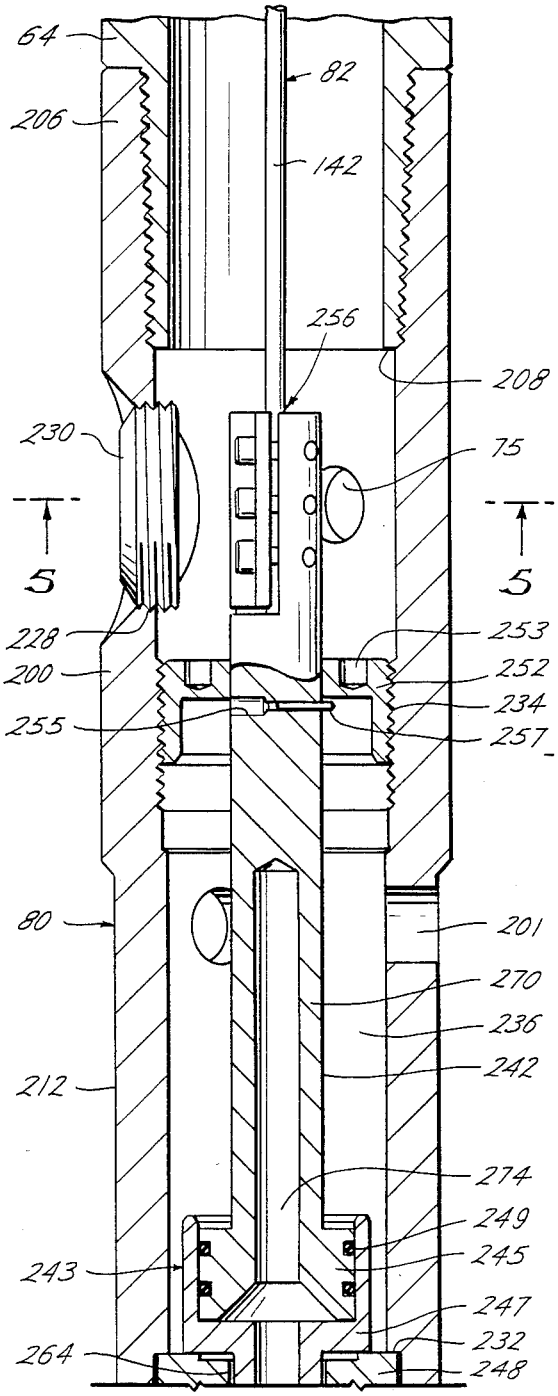
FIGS. 3A and 3B are enlarged cross-sectional views of the firing mechanism of the apparatus shown in FIG. 1.
Figure 3B:
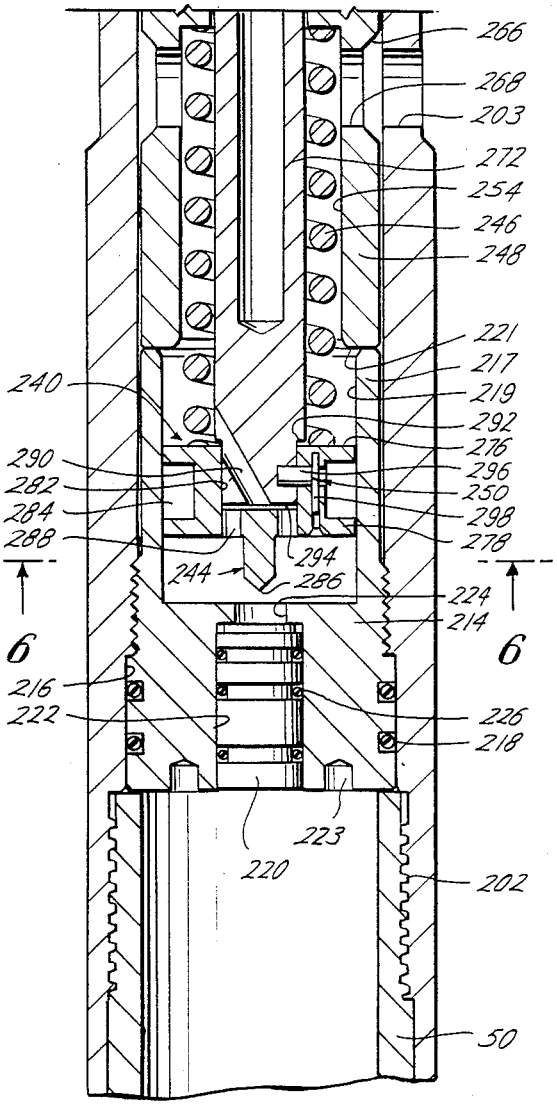

Referring now to FIGS. 3A and 3B, gun firing mechanism 80 includes a generally cylindrical housing 200 and a detonator means 240. Housing 200 is threadingly secured by means of threads 202 to one end of perforating gun 50. Seal means (not shown) are provided for sealing the connection between gun 50 and firing mechanism 80. Although FIG. 1 discloses firing mechanism 80 disposed uphole or on top of gun 50, firing mechanism 80 could be disposed downhole or on the bottom of gun 50. If mechanism 80 were on the bottom of gun 50, force transmission means 82 would be adapted to extend from pressure responsive means 70 to firing mechanism 80 below gun 50. As shown in FIG. 1, housing 200 extends upwardly and is connected at its upper end to drill pipe string 64 including drill pipe member 106 attached to the lower end of pressure responsive means 70. Means for making a rotary shouldered connection with pipe string 64 is provided at the upper end of housing 200, e.g. a correlative threaded box 206 with shoulder 208 at the top. Thus, threaded box 206 threadingly receives the pin end of the lowermost drill pipe member in pipe string 64.

Housing 200 includes a medial reduced diameter portion 212 having a plurality of equalizing ports 201, 203 therethrough for communicating lower borehole annulus 34 shown in FIG. 1 with the interior bore 236 of housing 200. A sealed plug 214 is received within a counterbore 216 in the lower end of housing 200 and threaded to housing 200 at 215. Plug 214 is sealed with the wall of counterbore 216 by seal means 218, such as O-rings housed in annular grooves in plug 214. Plug 214 incudes a coaxial bore 222 within which is disposed an initiator 220 for initiating the detonation of gun 50. Bore 222 has a reduced diameter entrance 224 for receiving firing pin 224 described hereinafter. Seal means 226, such as O-rings, are provided to seal initiator 220 within bore 222. Plug 214 further includes an upper tubular portion 217 extending upwardly into interior bore 236 of housing 200 and forming a cylindrical chamber 219 for receiving firing pin 244. Plug 214 has blind bores 223 in its lower face for the insertion of a tool during installation.

Adjacent the box end 206 of housing 200 is a large threaded bore 228 threadingly receiving a closure plug 230. Bore 228 permits access to the interior of housing 200 for the attachment of the lower end of cable 142 to firing mechanism 80 by connection means 256 as hereinafter described. Equalizing and flow ports 75 are also provided through housing 200 adjacent bore 228 for pressure equalization and hydrocarbon flow.

The interior of housing 200 includes an inwardly projecting annular shoulder 232 below ports 201 for the installation of detonator means 240 as hereinafter described.

Detonator means 240 includes a shaft 242, firing pin 244, a coiled spring 246, a tubular member 248, a shear connection 250, and a retainer ring 252. Firing pin 244 is releasably affixed to one end of shaft 242 by shear connection 250 and is disposed in chamber 219 of plug 214 adjacent entrance 224 to initiator 220. The shaft 242 extends upwardly through the bore 254 of tubular member 248 and is attached at its other end to the lower end of cable 142 by connection means 256. Connection means 256, shown in FIG. 5, includes a vertical flat 258 at the end of shaft 242 and a T-plate 260. T-plate 260 and flat 258 have opposing vertical half grooves for receiving the lower end of cable 142. Set screws 262 are provided for securing T-plate 260 to flat 258 so as to securely connect the lower end of cable 142 to shaft 242.

Tubular member 248 slidably engages the interior wall of housing 200 and the upper end of member 248 abuts downwardly facing shoulder 232 of housing 200 thereby limiting the insertion of member 248 within bore 236 of housing 200. The upper end of member 248 includes an inwardly projecting annular flange 264 for engagement with one end of spring 246. The lower end of member 248 contacts and abuts the upper end of upper tubular portion 217 of plug 214 thus capturing member 248 between shoulder 232 and plug 214. The internal diameter of member 248 is greater than that of chamber 219 in plug 216 thereby creating a downwardly facing shoulder 221. Flow ports 268 are provided in an annular groove 226 in tubular member 248 to communicate bore 254 with lower borehole annulus 34 via equalizing ports 203 in housing 200. Flow ports 268 are located adjacent equalizing ports 203 upon the engagement of shoulder 232 with the upper end of member 248.

Retainer ring 252 threadingly engages threads 234 of housing 200 and has a coaxial bore slidably receiving that end of shaft 242 attached to cable 142. Ring 252 also has blind bores 253 for the insertion of a tool during installation.

Spring 246 is inserted into bore 254 against shoulder 232 and receives that end of shaft 242 connected to firing pin 244. Firing pin 244 is provided with a face 276 towards spring 246 to capture spring 246 between face 276 and shoulder 232.

Figure 6:
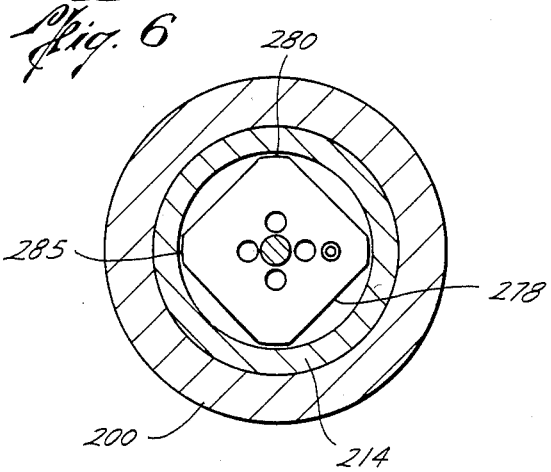
FIG. 6 is a cross-sectional view of the firing mechanism taken at plane 6—6 shown in FIG. 3.

Firing pin 244 includes a generally rectangular body 278 with truncated corners 280 as shown in FIG. 6. A coaxial blind bore 282 is provided in body 278 for receiving one end of shaft 242. Horizontal channels 284 are provided past corners 280 and vertical channels 285 are provided around corners 280. A point 286 extends downwardly from the lower face of body 278 for passing through entrance 224 to impact initiator 220. A plurality of equalizing ports 288 pass through the bottom of blind bore 282 to communicate with equalizing port 290 extending from the end of shaft 242 to a point above the upper face 276 of body 278. The end of shaft 242 has an annular stop shoulder 292 engaging upper face 276 to limit the insertion of shaft 242 into blind hole 282 and insure a clearance 294 between the end of shaft 242 and bottom of blind bore 282 for equalizing fluid flow.

Shear connection 250 includes one or more shear pins 296 extending through a hole in firing pin body 278 and into a blind hole in the end of shaft 242. A securement pin 298, installed in a vertical hole in body 278, prevents shear pin 296 from backing out of engagement with shaft 242.

The interior of firing mechanism 80 is pressure balanced with the lower borehole annulus pressure. This pressure equalization is permitted by equalizing ports 75, 201, 203 in housing 200, flow ports 268 in tubular member 248, equalizing ports 288 and horizontal and vertical channels 284, 285 in firing pin 244, equalizing port 290 in the end of shaft 242, and clearance 294 between shaft 242 and firing pin 244. These permit the free flow of fluid within housing 200 above initiator 220 such that firing mechanism 80 is pressure balanced. Further, these equalizing ports and channels permit the uninhibited reciprocation of shaft 242 and firing pin 244 within housing 200 during cocking and detonation.

Shaft 242 includes an upper portion 270 and a lower portion 272 with a hydraulic connection 243 above tubular member 248 connecting portions 270, 272 for safety. Connection 243 includes an enlarged pin piston 245 disposed on the end opposite that part of upper shaft portion 270 connected to cable 142 and an enlarged pin cylinder 247 disposed on the end opposite that part of lower shaft portion 272 connected to firing pin 244. Enlarged pin piston 245 is telescopingly received by enlarged pin cylinder 247 and is sealingly engaged therewith by O-ring seals 249 housed in annular grooves in the outer periphery of pin piston 245. Upper shaft portion 270 and lower shaft portion 272 have coaxial blind bores which form an atmospheric chamber 274. The mouth of the blind bore in upper shaft portion 270 is conical shaped to insure alignment between the blind bores. Since the external pressure, i.e. lower annulus pressure, around shaft 242 will be substantially greater than the atmospheric pressure in chamber 274, connection 243 will remain secure. However, if firing mechanism 80 were to be raised to the surface 12, the external pressure around shaft 242 will also be at atmospheric pressure permitting connection 243 to disengage and disarm perforating gun 50.

Enlarged pin cylinder 247 forms a downwardly facing annular shoulder which abuts the top of tubular member 248. This engagement limits the downward travel of firing pin 244 thus preventing any premature detonation of gun 50 caused by an unplanned upward pull on shaft 242 which might cock firing pin 244.

Upper shaft portion 270 has a horizontal pin hole 255 therethrough located just below retainer ring 252 in the lower shaft position for receiving a roll pin 257. Roll pin 257 abuts beneath retainer ring 252 to retain hydraulic connection 243 in place and prevents hydraulic connection 243 from pulling apart accidentally during assembly. Roll pin 257 shears during operation as cable 142 pulls shaft 242 upwardly.

Except under certain conditions such as for example in shallow wells, packer 30 is used to isolate the hydrostatic in upper annulus 32 from the lower annulus 34, for the perforation of formation 14. It should be understood, however, that the present invention is not limited to the use of a packer and could be adapted to be actuated without the use of a packer. Once valve 60 is opened to release the trapped pressure below the packer 30, the pressure in the tubing 26 and lower annulus 34 equalizes. At this time two separate pressure systems have been created, namely the 32 upper annulus pressure and the 34 lower annulus pressure. Since the lower annulus pressure determines whether there is an underbalance or overbalance on the formation, i.e. lower annulus pressure is less or more than the formation pressure of formation 14, it is particularly useful to utilize the upper annulus pressure system to actuate the detonation of the perforating gun 50. By using upper annulus pressure, no pressurization of the tubing flow bore 40 or lower annulus 34 is required nor is it necessary to mechanically detonate the gun by passing a bar through all of the test equipment, including valve 60 which would have to be fully open to permit the passage therethrough of the bar. Thus it is a principle object of the present invention to activate the detonation of gun 50 using the upper wellbore annulus 32 rather than either the tubing flow bore 40 or lower borehole pressure annulus 34. In summary, the present invention initiates the detonation of gun 50 through the pressurization of the fluids in upper annulus 32 to open the valve 60 and then utilize the pressure differential across the packer 30 for transmitting a signal to the gun 50 located in the lower annulus 34 for the actuation and detonation thereof.

OPERATION OF EMBODIMENT OF FIGS. 2-6

In utilizing the apparatus shown in FIGS. 2-6 to carry out the method of the present invention in testing formation 14, the present invention is assembled and armed by making up pressure responsive means 70 and firing mechanism 80 on pipe string 64 without cable 142. The tool string is then lowered into tubing string 26 until pressure responsive means 70 is in position on rig 18. The cable 142 is attached to pressure responsive means 70 and is lowered through pipe string 64 with a weight until it reaches firing mechanism 80. The tool string is then raised until firing mechanism 80 is in position on rig 18 and cable 142 is connected to firing mechanism 80 via access port 228.

The tool string as shown in FIG. 1 is then lowered into borehole 10. Although flow ports 73 in perforated nipple 72 and equalizing ports 75 in gun firing mechanism 80 permit the well fluids in wellbore 24 to flow into that portion 56 of flow bore 40 of tubing string 26 extending below valve 60, valve 60 is closed thereby preventing the well fluids from flowing further up the tubing flow bore 40 above valve 60 indicated at 58.

Equalizing and flow ports 75 in gun firing mechanism 80 permit circulation across the top of gun firing mechanism 80 to prevent the collection of any debris and also may be used to wash around cable connection means 256 upon the disconnection of cable 142 from gun firing mechanism 80. Further, ports 75 may permit the flow of hydrocarbons from the lower annulus 34 into tubing blow bore 40.

There will be free access between the wellbore annulus 28 and tubing flow bore 40 around piston means 76 due to flow ports 72 and equalizing ports 75 as the tool string is lowered into the well providing a U-tube effect on piston means 76. Thus, with respect to pressure responsive means 70, the pressures across piston sleeve 116 are equal. Until packer 30 is set and valve 60 is opened, the pressures on the upper and lower ends of piston sleeve 116 will remain the same and prevent any cocking of firing pin 244. There is, however, a pressure differential across valve 60.

The hydrostatic head of well fluids in wellbore annulus 28 is greater than the formation pressure to control the well until the setting of packer 30. If the hydrostatic head in tubing string 26 were to be greater than the formation pressure at the time of perforation, well fluids in lower annulus 34 would tend to flow into the formation 14, i.e. towards the lower pressure. Therefore, it is desirable to reduce the hydrostatic head in tubing string 26 to a predetermined pressure less than the formation pressure to obtain an underbalance or pressure differential towards the flow bore 40 of tubing string 26. Thus, the portion 58 of flow bore 40 above valve 60 may be substantially dry or may include a predetermined column of fluid such as water, diesel, or light crude. By maximizing the underbalance using a jet type casing perforator gun, deeply penetrating perforations are provided with an immediate cleanup due to high backsurge pressures resulting in maximum hydrocarbon flow from formation 14. Perforating with high differential pressure toward lower annulus 34 backsurges the perforations 44 and tunnels 46 to flush out debris and compaction caused by the cementing and perforating operations.

Once perforating gun 50 is adjacent formation 14, a logging tool is run down tubing string 26 to valve 60 to insure that gun 50 is properly positioned with respect to formation 14. At that time, packer 30 is set, dividing borehole annulus 28 into upper annulus 32 and lower annulus 34. Upon setting packer 30, the lower annulus pressure caused by the hydrostatic head in wellbore annulus 28 is trapped beneath packer 30 and valve 60.

One method taught by the prior art is to simultaneously open the dry tubing string at the time of perforation. See U.S. Pat. No. 2,906,339. Such a procedure has severe shortcomings. If the trapped bottomhole pressure is released suddenly at the time of perforation, a sudden pressure differential is created across casing 16 adjacent formation 14 as the trapped bottomhole pressure and formation fluids rush to the surface through the tubing string 26. This sudden pressure release causes a shock wave amounting to a kinetic force moving from the formation to the surface. Since the perforations through the casing are not large enough to take this shock force, the casing will, in many instances, collapse, ruining the well. Further, the shock wave will tend to move packer 30 thereby causing the packer to lose its seal. Thus, a blowout could occur.

The preferred method is to vent the trapped bottomhole pressure below packer 30 prior to perforation. This release of the trapped bottomhole pressure permits the stresses, such as stress risers, in casing 16 to flow and distribute, creating a static pressure differential across the casing rather than a dynamic pressure differential. Thus, the formation pressure becomes a static force around casing 16 rather than a dynamic force. By venting the trapped bottomhole pressure, the bottomhole pressure becomes substantially the same as the pressure in tubing flow bore 40, creating a large static pressure across the casing. Upon perforation, the formation pressure is all vented through the perforations, permitting an enhanced backsurging.

To relieve the trapped pressure, pump pressure is applied to the well fluids in upper annulus 32 causing a pressure differential between upper annulus 32 and the pressure trapped below valve 60. This pressure differential opens valve 60 but is insufficient to shear pins 138 of piston sleeve 116. Therefore, piston sleeve 116 does not move. The opening of valve 60 relieves the pressure which was trapped in lower annulus 34, and the pressure of portion 58 of tubing flow bore 40 equalizes with the pressure of portion 56 of tubing flow bore 40 and lower annulus 34.

Until a pressure differential is created across piston sleeve 116, piston sleeve 116 cannot move upwardly in annular space 118 of pressure responsive means 70 since the upper annulus pressure equals the lower annulus pressure and thus there is no pressure differential across piston means 76. However, once valve 60 is opened, the lower annulus pressure no longer equals the upper annulus pressure and a pressure differential is created across piston sleeve 116. Shear pins 138 require that pressure in upper annulus 32 be increased to a predetermined pressure differential to shear pins 138 securing piston sleeve 116. Shear pins 138 may, of course, be sized to shear at a variety of pressure differentials. After shear pins 138 are sheared, the pressure differential between upper annulus 32 and tubing flow bore 40 causes piston sleeve 116 to travel upwardly in annular space 118 as the upper annulus pressure acts on end 132 of piston sleeve 116 via pressure chamber 74 and flow ports 140.

Shear pins 138 cause piston sleeve 116 to begin upward travel at a predetermined and known pressure differential across piston means 76. This is often desirable, for example, for detection purposes or for packer testing.

It may be desirable to test packer 30 after valve 60 is opened and before gun 50 is detonated. By pinning the piston sleeve 116 with shear pins 138 set to shear at a pressure differential greater than that required to open valve 60 and test packer 30, this packer test can easily be accomplished. However, even if during the testing of packer 30 upper annulus 32 is pressurized and gun 50 detonates, packer 30 must have held since otherwise gun 50 could not have been fired. It is necessary for packer 30 to hold the annulus pressure to permit sufficient pressure actuation of piston sleeve 116 to cock and release firing head 244.

The opening of valve 60 may be detected at the surface due to the pressure flux caused by the relief of the pressure trapped below valve 60. Further, another pressure flux is detected at the surface upon the detonation of gun 50. If the fluid pressure is not permitted to normalize after the opening of valve 60, the detonation of gun 50 may not be detected. Thus it may be preferred that there is a time delay between the opening of valve 60 and the detonation of gun 50 to permit the fluid pressures to normalize. This is insured by pinning piston sleeve 116 with shear pins 138 in the pressure responsive means 70. For example, shear pins 138 may be set to shear at a pressure differential 1,000 psi greater than the pressure required to open valve 60. Thus to detonate after valve 60 is opened, an additional 1,000 psi annulus pressure would be required to shear pins 138 and permit piston sleeve 116 to travel upwardly to detonate gun 50 as hereinafter described.

However, it should be clear that although shear pins 138 are preferred, shear pins 138 may be unnecessary in certain situations and therefore be eliminated.

As piston sleeve 116 moves upwardly within annular space 118, piston sleeve 116 puts tension on cable 142 causing shaft 242 to travel upwardly with firing pin 244. This upward movement compresses spring 246 between shoulder 264 and face 276 of firing pin 244. After face 276 of firing pin 244 engages the downwardly facing shoulder 221 of tubular member 248, further upward travel of firing pin 244 is prevented. Once the force of cable 142 on shaft 242 exceeds the yield strength of shear pins 296, pins 296 will shear and sever shear connection 250.

Upon releasing firing pin 244, spring 246 propels firing pin 244 on shaft 242 downwardly, impacting initiator 220 whereupon the shaped charges 52 of gun 50 are detonated and the casing 16 perforated. Deeply-penetrating perforations 44 and tunnels 46 are formed in formation 14, reaching sterile zone 54 and immediate backsurge and cleanup occur with high backsurge pressures and maximum hydrocarbon flow with the high pressure differential towards tubing flow bore 40. The perforating forms a flow path along which hydrocarbons from formation 14 can then flow through perforations 44 and tunnels 46, into the lower annulus 34, uphole through flow ports 73 and 75 into tubing flow bore 40, and to the outlet 38 where the production is gathered in the usual manner.

If the operator should decide not to perforate and complete the well, valve 60 is closed by bleeding the pressure in upper annulus 32, and packer 30 is unseated. After the packer 30 is unseated, the pressures across piston sleeve 116 are equalized thus eliminating cable tension and disarming firing mechanism 80. Spring 160 above piston sleeve 116 moves piston sleeve 116 downwardly in annular space 118 until shoulders 136 engage. This downward movement puts slack in cable 142. When access port 228 in housing 200 comes to the surface 12, cable 142 is disconnected at connection 256 from shaft 242 and firing mechanism 80 is removed. Gun 50 is then brought above ground.

As gun 50 is removed from borehole 10, firing mechanism 80 cannot be cocked so as to fire the gun. The only way that piston means 76 could be in a cocked position is if it hangs up within annular space 118. However, there is nothing in annular space 118 for piston means 76 to hang on. Further, piston means 76 is never mechanically held in the cocked position. Only if piston means 76 travels upwardly a sufficient distance to shear pins 296 will it detonate. Thus, holding piston means 76 in a partial travel up annular space 118 will not permit pins 296 to shear and detonate gun 50.

Although the apparatus of FIGS. 2–6 has been described in detail with respect to formation testing, the apparatus may also be used in other methods such as well completions. The following is a further discussion of the present apparatus and its use for well completions. Where the designations of FIGS. 1–6 are identical to or substantially the same as that described with respect to the following well completion methods, the same names and numerals will be used.

Figure 7:
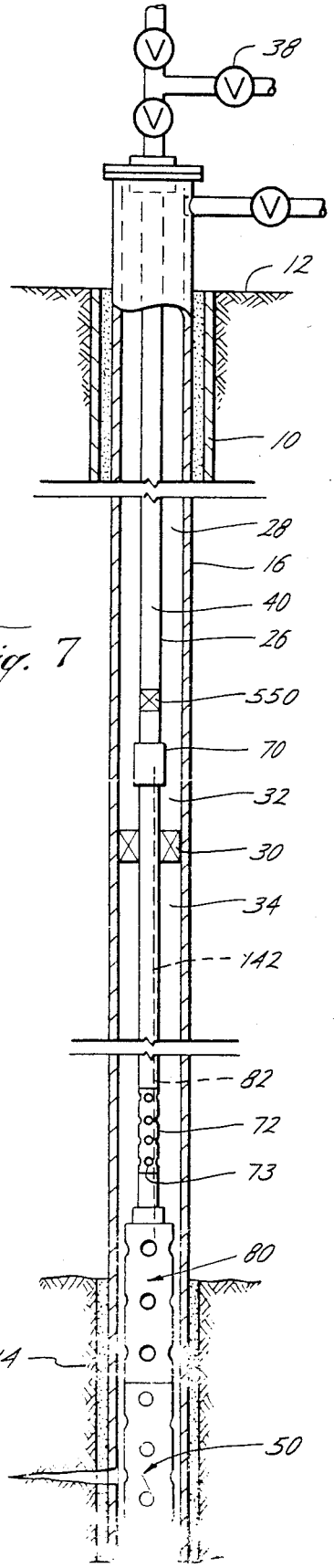
FIG. 7 is a fragmentary, part cross-sectional view of a borehole having apparatus made in accordance with the present invention for completing a well.

Referring now to FIG. 7, there is shown the borehole 10 of FIG. 1 with casing 16 passing through formation 14 to be completed. The tool string includes tubing string 26, pressure responsive means 70, packer 30, tubing valve means 550, perforated nipple 72 with flow ports 73, firing mechanism 80, and perforating gun 50. Pressure responsive means 70 includes force transmission means 82, such as cable 142, extending from pressure responsive means 70 to firing mechanism 80. Tubing valve means 550 is preferably disposed in tubing string 26 above pressure responsive means 70 to avoid passing cable 142 through tubing valve means 550. Where tubing valve means 550 is disposed above pressure responsive means 70, and since pressure responsive means 70 is located above packer 30, the described tool string requires that tubing valve means 550 also be located above packer 30. However, it should be understood that tubing valve means 550 may be located adjacent and above perforated nipple 72 and below packer 30 where tubing valve means 550 is provided with means for passing force transmission means 82 from pressure responsive means 70, through tubing valve means 550, to firing mechanism 80.

Tubing valve means 550 may include the commercial valves described with respect to valve 60 of the preferred embodiment and be actuated by hydraulic pressure, rotation or reciprocation. Hydraulically actuated valves are actuated by increasing the annulus pressure in upper annulus 32. However, tubing valve means 550 might also include a blanking plug set in a profile disposed in tubing string 26 whereby the blanking plug is removed to create the pressure differential across the piston means 76 of pressure responsive means 70. Other suitable tubing valve means 550 may be devised by those skilled in the art.

In the operation of the method disclosed in FIG. 7 for the completion of formation 14, the tool string as described is assembled and lowered into the cased borehole with well fluids flowing through flow ports 73 of nipple 72 and up into flow bore 40 to tubing valve means 550. A predetermined level of fluid is placed in tubing string 26 above tubing valve means 550 to achieve the desired underbalance upon perforation.

Once perforating gun 50 is properly positioned adjacent formation 14, packer 30 is set to divide the borehole annulus 28 into upper annulus 32 and lower annulus 34. The piston means 76 of pressure responsive means 70 cannot travel upwardly until tubing valve means 550 is opened. Tubing valve means 550 is then opened to relieve the trapped pressure in lower annulus 34 and tubing flow bore 40 below valve means 550 and to cause the pressure differential across the piston means 76 of pressure responsive means 70. Once tubing valve means 550 is opened, the piston means 76 of pressure responsive means 70 reciprocates, force is transmitted through cable 142 to firing mechanism 80 to move the shaft 242 and firing pin 244 of firing mechanism 80 upwardly and compress the spring 246. Once the firing pin 244 is prevented from further upward movement, a further upward force will cause the shear pins 296 to shear. The firing head is then propelled downwardly to impact the initiator 220 of gun 50 to detonate the shaped charges 52 thereof. Hydrocarbons then flow through the perforations into flow ports 73 of nipple 72 and up through open tubing valve means 550 to the surface.

It is also envisioned that the method and apparatus of the present invention may be accomplished without a tubing valve means. For example, the tool string described with respect to FIG. 7, with the exception of tubing valve means 550, may be lowered into the well with the well fluids flowing through flow ports 73 to create a hydrostatic head within tubing flow bore 40 equal to the hydrostatic head in wellbore annulus 28. Since the hydrostatic heads are equal, there is no pressure differential across the piston means 76 of pressure responsive means 70.

Prior to setting packer 30, the well fluids within tubing flow bore 40 may be displaced by pumping nitrogen down tubing flow bore 40 to circulate the well fluids out of bore 40 and through flow ports 73 and up wellbore annulus 28. Pump pressure is maintained on tubing flow bore 40 to insure pressure equalization between tubing flow bore 40 and wellbore annulus 28.

Packer 30 may then be set and the nitrogen in tubing flow bore 40 bled off, creating a differential pressure across the piston means 76 of pressure responsive means 70. Upon reaching the desired differential pressure, the piston means 76 in pressure responsive means 70 will have travelled sufficiently to activate firing mechanism 80 and shear the shear connection 250 to detonate gun 50.

In either of the two above descriptions with respect to FIG. 7, piston means 76 of pressure responsive means 70 may include shear pins 138 to permit the travel of the piston sleeve at a preset differential pressure across the piston means 76 of pressure responsive means 70. Also, in both of the above methods, the desirable underbalance may be established to create the desirable backsurge on the perforation.

EMBODIMENTS OF FIGS. 8–16

While FIGS. 2–6 illustrate one embodiment of the apparatus of the present invention, other embodiments of the apparatus are shown in FIGS. 8–16. Referring initially to FIGS. 8A and 8B an upper pressure responsive means 300 is series connected in tubing string 26 above packer 30 as shown in FIGS. 1 and 7. Upper pressure responsive means 300 would be located at the same location as pressure responsive means 70 shown in FIGS. 1 and 7.

Upper pressure responsive means 300 includes an outer cylinder or tubular member 302 having internal threads 304 for threadingly engaging external threads on a lower sub 306. Lower sub 306 includes an upwardly extending inner mandrel or tubular portion 308. Cylinder 302 and lower sub 306 have a common flow passageway 310 extending axially therethrough and forming a portion of tubing flowbore 40 shown in FIGS. 1 and 7. The upper end of cylinder 302 and the lower end of sub 306 include means for making rotary shouldered connections with adjacent drill pipe members 312, 314, respectively, of pipe string 64.

A force transmission means 320 is disposed in flow passageway 310 above the upper end of mandrel 308 and within the bore of cylinder 302. Force transmission means 320 includes a generally tubular body 316 abutting a downwardly facing, inwardly directed annular shoulder 318 in cylinder 302. A tubular extension 322 extends between tubular body 316 and mandrel 308. The lower end of tubular body 316 includes a reduced diameter portion 324 having an outer diameter substantially the same as the outer diameter of tubular extension 322.

Reduced diameter 324 also includes another reduced diameter or counterbore 326 which is slidingly received by the upper end of tubular extension 322. O-ring seals 328 are housed in annular grooves disposed in the interior surface of the upper end of tubular extension 322 for sealingly engaging the exterior surface of counterbore 326. The lower end of tubular extension 322 telescopingly receives the upper end of mandrel 308 and includes an inwardly directed annular shoulder 323 which engages the upper end of mandrel 308. O-rings 332 are housed in annular grooves in the internal surface of the lower end of tubular extension 322 for sealingly engaging the external surface of the upper end of mandrel 308. The outer diameter of mandrel 308, therefore, is smaller than the inner diameter of cylinder 302. Thus, the annular gap between the interior of cylinder 302 and the exterior of counterbore 324 and the outer diameter of tubular extension 322 and the outer diameter of mandrel 308 form an annular chamber 340 extending from the threads 304 to the upper end of reduced diameter 324 on tubular body 316.

Upper piston means 350 includes an annular piston sleeve 352 having an inner and outer diameter sized to permit piston sleeve 352 to be disposed around mandrel 308 in annular chamber 340. Inner O-rings 334 are disposed in annular grooves on the inner periphery of piston sleeve 352 to sealingly engage the exterior wall of mandrel 308, and outer O-rings 336 are disposed in annular grooves on the outer periphery of piston sleeve 352 to sealingly engage the interior wall of cylinder 302. Piston sleeve 352 divides the lower part of chamber 340 into upper and lower portions which expand and contract upon the reciprocation of piston sleeve 352 within the lower part of chamber 340 around mandrel 308.

Pressure communication means 360 is provided in cylinder 302 and includes a plurality of ports 338 passing through the lower end of cylinder 302 above threads 304 to provide fluid communication between upper borehole annulus 32 and that portion of chamber 340 below piston sleeve 352. An incompressible fluid, such as oil, fills that portion of chamber 340 extending above piston sleeve 352. Ports 338 have been located in the downhole end of chamber 340 to prevent any debris in borehole annulus 32 from settling into chamber 340. A screen may be provided over ports 338 to filter any large particulate material and prevent such material from passing into chamber 340. Shear pins 342 may be provided in the lower end of piston sleeve 352 and extending into corresponding blind bores in mandrel 308 for reasons to be hereinafter described.

Figure 8A:
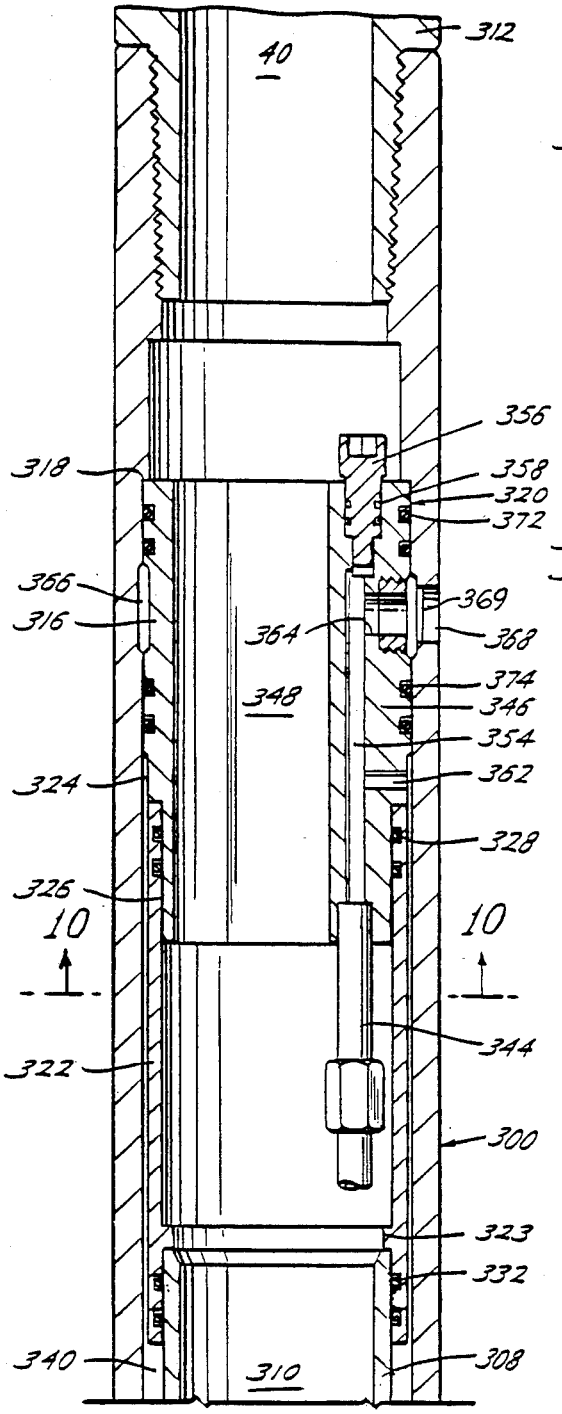
FIGS. 8A and 8B are enlarged cross-sectional view of another embodiment of the pressure responsive means of the apparatus shown in FIGS. 1 and 7.
Figure 8B:
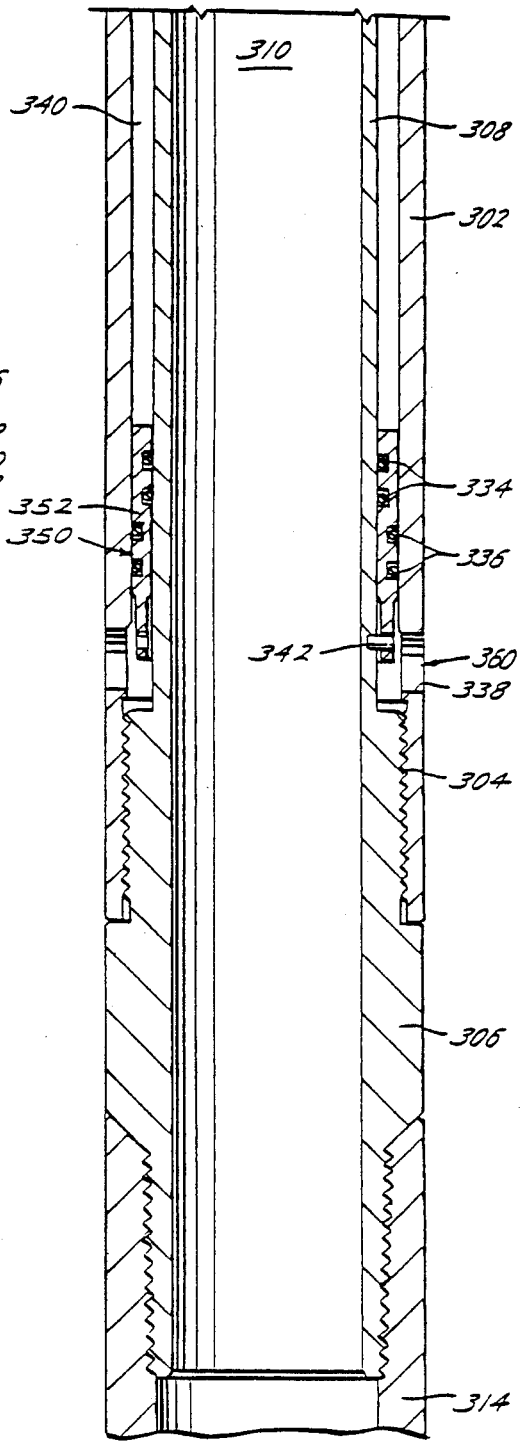
Figures 9A, 9B, 9C, 15:
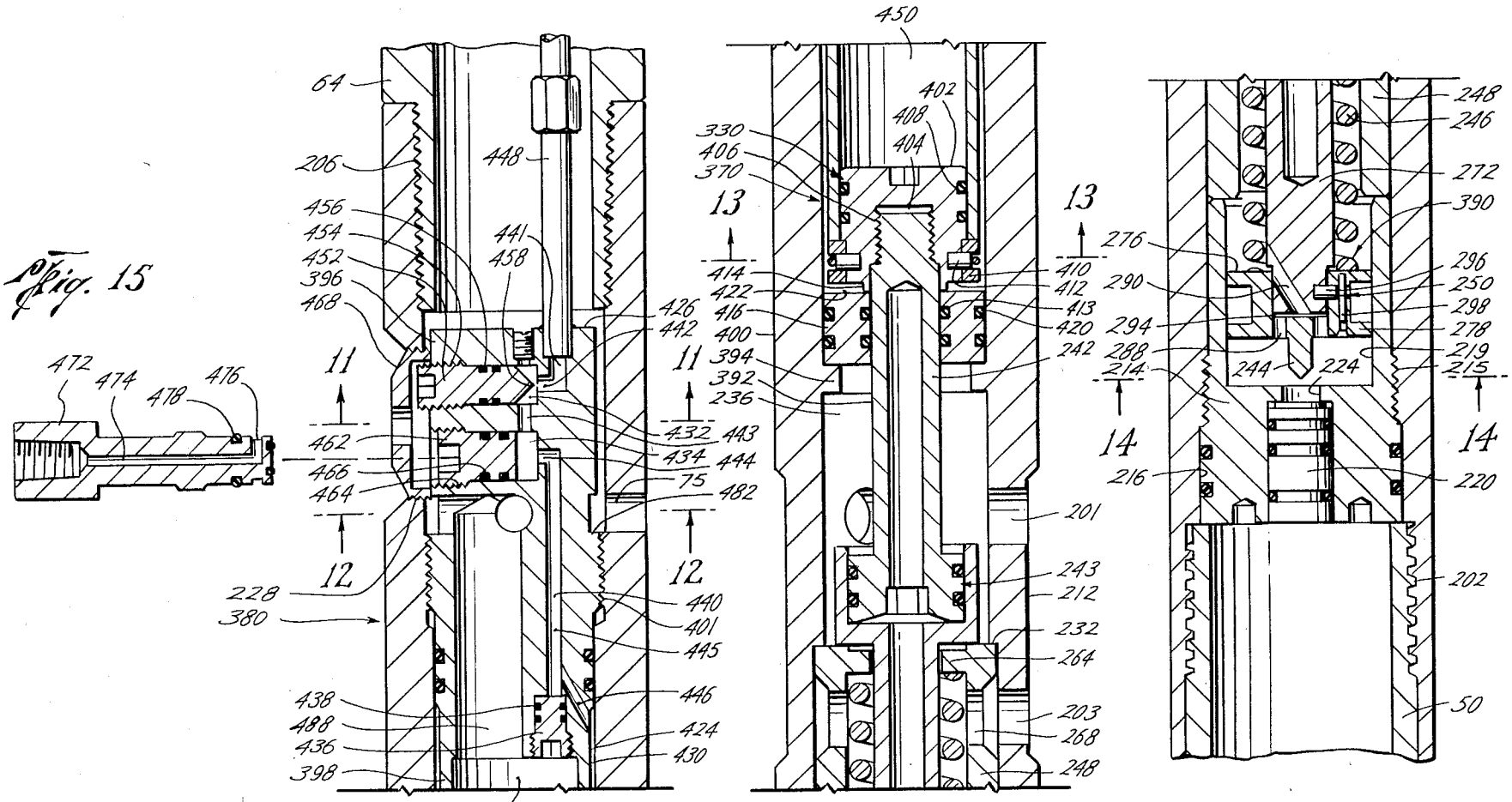
FIGS. 9A, 9B, and 9C are enlarged cross-sectional views of another embodiment of the firing mechanism for the apparatus shown in FIGS. 1 and 7.
FIG. 15 is a cross-sectional view of an adapter for the firing mechanism of FIG. 9.
Figure 10:
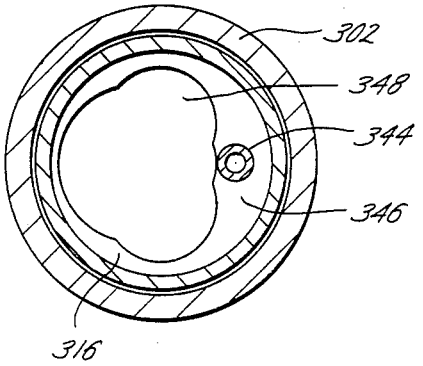
FIG. 10 is a cross-sectional view of the pressure responsive means of FIG. 8 taken at plane 10—10 in FIG. 8.
Figure 11:
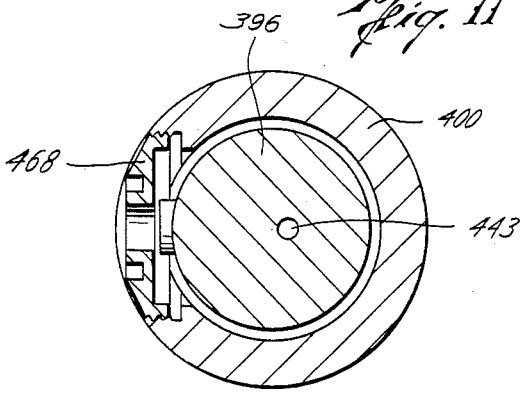
FIG. 11 is a cross-sectional view of the firing mechanism of FIG. 9 taken at plane 11—11 in FIG. 9.
Figure 12:
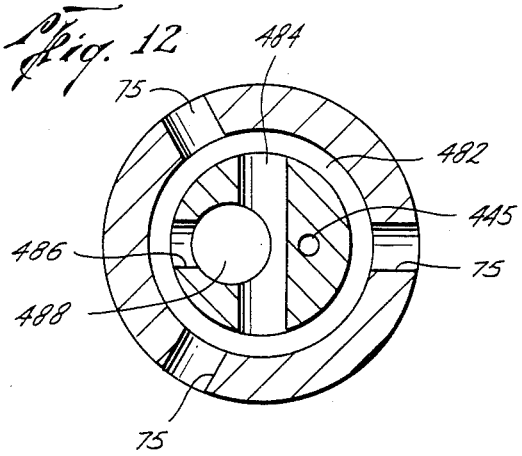
FIG. 12 is a cross-sectional view of the firing mechanism of FIG. 9 taken at plane 12—12 in FIG. 9.
Figure 13:
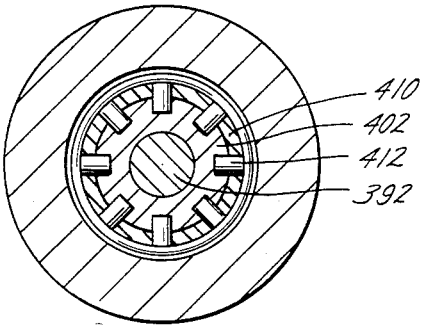
FIG. 13 is a cross-sectional view of the firing mechanism of FIG. 9 taken at plane 13—13 in FIG. 9.
Figure 14:
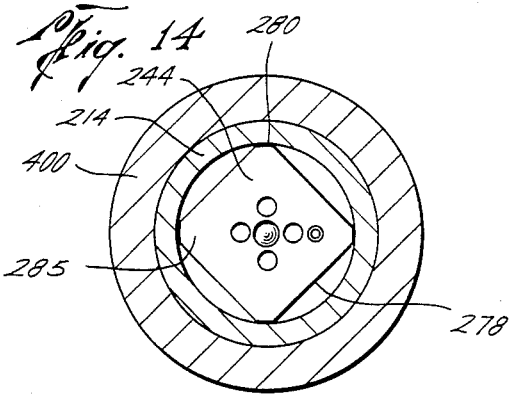
FIG. 14 is a cross-sectional view of the firing mechanism of FIG. 9 taken at plane 14—14 in FIG. 9.

Referring now to FIGS. 8A, 8B, 9A, 9B, and 9C, force transmission means 320 includes tubular member 316 and a conduit 344 extending from upper pressure responsive means 300 to lower pressure responsive means 370 of firing mechanism 380 shown in FIGS. 9A, 9B and 9C. The incompressible fluid in the fluid system from upper piston means 350 to lower piston means 330 is displaced from upper pressure responsive means 300 to lower pressure responsive means 370 via conduit 344. Tubular body 316 includes a thick portion 346 extending axially and an axially extending flow bore 348 best shown in FIG. 10. Flowbore 348 has a cross-sectional area which is equivalent to the cross-sectional area of flowbore 310. Thus, there is no flow restriction through forced transmission means 320.

Referring now to FIGS. 8A and 8B, thick portion 346 of tubular body 316 includes an axial bore 354 extending therethrough. Conduit 344 is sealingly attached by a suitable high-pressure connection at the lower outlet of bore 354. The upper end of bore 354 is plugged by plug member 356. Plug member 356 is threadingly received within the upper end of bore 354 and includes seal means 358 sealingly engaging the interior of bore 354.

Radial passage means 362 extends between bore 354 and the upper end of annular chamber 340 for the displacement of fluid therethrough. A radial fill port 364 is provided above radial passage 362 and extends to an annular groove 366 around the exterior of tubular body 316. A fill hole 368 is provided through cylinder 302 at groove 366 whereby an incompressible fluid such as oil can pass through hole 368, groove 366 and fill port 364 for filling force transmission means 320 with an incompressible fluid such as oil. Appropriate means are provided for plugging hole 368 and fill port 364 after filling. Upper and lower seal means 372, 374 are provided above and below annular groove 366, respectively, to seal annular groove 366 from flow passageway 310 and annular chamber 340.

Conduit 344 extending from upper pressure responsive means 300 to lower pressure responsive means 370, includes a stainless steel tube which will not bend easily and has a small diameter, such as $\frac{1}{4}$ inch, as compared to the internal diameter of flow passageway 310 so as not to restrict flow through tubing flow bore 40. A coating, such as Teflon made by DuPont, can be applied to the exterior surface of conduit 344 to protect the conduit in particularly corrosive well environments. As can be apreciated, as piston 350 moves upwardly within the lower part of chamber 340, the incompressible fluid is forced upwardly in chamber 340, through radial passageway 362 and into axial bore 354. Incompressible fluid is then displaced down conduit 344 to lower pressure responsive means 370.

Referring now to FIGS. 9A, 9B and 9C, gun firing mechanism 380 includes a lower pressure responsive means 370, detonator means 390, and a cylindrical housing 400. Although gun firing mechanism 380 is described mounted above perforating gun 50, gun firing mechanism 380 could also be disposed below gun 50. Because many of the features of gun firing mechanism 380 are substantially the same as those of gun firing mechanism 80 shown in FIGS. 3A and 3B, those features which are substantially the same will be repeated with the same numerical designation as shown in FIGS. 3A and 3B. Where the same numerical designation is shown in both FIGS. 3A and 3B and 9A, 9B and 9C, the description of that feature with respect to FIGS. 3A and 3B will be the same as that for FIGS. 9A, 9B and 9C and therefore not repeated in detail.

Housing 400 is very similar to housing 200 in FIG. 3A and 3B. Housing 400 includes a medial reduced diameter portion 212 having a plurality of equalizing ports 201, 203 therethrough for communicating lower borehole annulus 34 with the interior bore 236 of housing 400. A seal plug 214 is received within a counterbore 216 in the lower end of housing 400 and threaded to housing 400 at 215.

Adjacent the box end 206 of housing 400 is a large threaded bore 228 for permitting access to the interior of housing 400. Equalizing and flow ports 75 are also provided through housing 400 adjacent bore 228 for pressure equalization and hydrocarbon flow.

The interior of housing 400 includes an inwardly projecting and downwardly facing annular shoulder 232 below ports 201 for the installation of detonator means 390 as hereinafter described.

Detonator means 390 is substantially identical to detonator means 240 of FIGS. 3A and 3B with the exception of upper shaft portion 392. Upper shaft portion 270 of FIGS. 3A and 3B is adapted for connection to cable 142 where upper shaft portion 392 of FIGS. 9A, 9B and 9C is adapted for attachment to lower pressure responsive means 370. Detonator means 390 includes a shaft 242, firing pin 244, a coil spring 246, a tubular member 248, and a shear connection 250. Retainer ring 252 of FIGS. 3A and 3B has been replaced by lower pressure responsive means 370. As in FIGS. 3A and 3B, firing pin 244 is releasably affixed to lower shaft portion 272 by shear connection 250 and is disposed in chamber 219 of plug 214 adjacent entrance 224 to initiator 220. Upper shaft portion 392 extends upwardly through tubular member 248 and is attached at its other end to lower pressure responsive means 370, as hereinafter described. The features of tubular member 248, spring 246, firing pin 244, and shear connection 250 are identical as shown in both FIGS. 3A and 3B and FIGS. 9A, 9B and 9C and therefore will not be described further. As in the firing mechanism 80 of FIGS. 3A and 3B, the interior of firing mechanism 380 of FIGS. 9A, 9B and 9C is pressure balanced with the lower borehole annulus pressure. This pressure equalization is permitted by equalizing ports 75, 201, 203 in housing 400, equalizing ports 268 in tubular member 248, equalizing ports 288 and horizontal and vertical channels 284, 285 in firing pin 244, equalizing port 290 in the end of shaft 242, and the clearance 294 between shaft 242 and firing pin 244. These, as in firing mechanism 80 of FIGS. 3A and 3B, permit the free flow of fluid within housing 400 above initiator 220 such that firing mechanism 380 is pressure balanced. Further, these equalizing ports and channels permit the uninhibited reciprocation of shaft 242 and firing pin 244 within housing 400 during cocking and detonation.

As previously indicated, shaft 242 includes an upper portion 392 and a lower portion 272 with a hydraulic connection 243 above tubular member 248 connecting portion 392, 272 for safety. Connection 243 shown in FIGS. 9A, 9B and 9C is substantially identical to that shown in FIGS. 3A and 3B.

As distinguished from housing 200 in FIGS. 3A and 3B, housing 400 includes an inwardly directed annular shoulder 394 above equalizing ports 201. Lower pressure responsive means 370 is disposed in bore 236 of housing 400 above shoulder 394.

Referring now to both FIGS. 9A, 9B and 9C and 13, lower pressure responsive means 370 includes a body 396 having a lower tubular portion or cylinder 398. Cylinder 398 forms a chamber 450 having a polished bore. A lower piston means 330, including a piston 402, is disposed in cylinder 398. Piston 402 includes a downwardly facing tapped bore 404 for threading engagement at 406 with the upper end of upper shaft portion 392 of shaft 242. Piston 402 is slidingly received within cylinder 398 and includes annular grooves therearound housing O-rings 408 for sealingly engaging the interior of cylinder 398. The lower end of piston 402 includes a counterbore for receiving a shear ring 410 around upper shaft portion 392. The outer diameter of shear ring 410 is substantially the same as the outer diameter of cylinder 398. Shear ring 410 is mounted on a reduced diameter portion of piston 402 by shear pins 412 extending into blind bores in the lower end of piston 402. The outer diameter of shear ring 410 is substantially equal to that of cylinder 398 and therefore abuts the lower end of cylinder 398.

Disposed around upper shaft portion 392 between piston 402 and annular shoulder 394 of housing 400 is a seal collar 416. Seal collar 416 includes inner and outer O-ring seals 418, 420, respectively, with inner seals 418 sealingly engaging the exterior of upper shaft portion 392 and outer seals 420 sealingly engaging the interior wall of housing 400 above shoulder 394. Piston 402 includes a downwardly projecting spacer ring 414. Spacer ring 414 projecting downwardly from piston 402 necessitates an annular gap 422 between piston 402 and seal collar 416 to provide a pressure area on piston 402 during operation as hereinafter described.

Body 396 includes a reduced outer diameter portion 424 extending from a point above cylinder 398 to the lower end of cylinder 398. Reduced diameter portion 424 forms the upper portion of an annular pressure chamber 430 between the exterior of reduced diameter portion 424 and the interior of housing 400.

A flow passageway 440 extends from the upper end 426 of body 396 to the upper portion of annular chamber 430. Flow passageway 440 includes a vertical blind bore 441 extending from upper end 426 to radial bore 442. Radial bore 442 communicates with turn-off chamber 432. An offset vertical bore 443 extends from turn-off chamber 432 and communicates with fill chamber 434. A radial blind port 444 communicates with fill chamber 434 and communicates with axial bore 445 extending through body 396 into chamber 450 of cylinder 398. A slanted bore 446 communicates vertical bore 445 with the upper portion of annular chamber 430. The lower end of vertical bore 445 is plugged and sealed by plug 436 having seals 438 therearound. The inlet of flow passageway 440 at upper end 426 includes high-pressure hydraulic connections 448 for connection to the lower end of conduit 344 extending downwardly from upper pressure responsive means 300.

Referring now to both FIGS. 9A, 9B, 9C and 11, a turn-off plug 452 is threadingly received within turn-off chamber 432 at 454. O-ring seals 456 are provided in annular grooves around turn-off plug 452 for sealing engagement with the interior of turn-off chamber 432. Turn-off plug 452 includes a conical end 458 for seating with the mouth of radial bore 442 to thereby prevent flow from radial bore 442 through turn-off chamber 432 and into axial bore 442 through turn-off chamber 432 and into axial bore 443 communicating with fill chamber 434.

A fill plug 462 is threadingly received at 464 within fill chamber 434. O-ring seals 466 are disposed in annular grooves around plug 462 for sealing engagement with the interior of fill chamber 434. Fill plug 462 permits access to fluid passage 440 for filling the system with an incompressible fluid such as oil.

Access to turn-off plug 452 and fill plug 462 are provided through access port 228 in housing 400. A closure cap 468 is provided for closing access port 228.

Referring now to FIGS. 9A, 9B, 9C and 15, FIG. 15 discloses an adapter 472 which may be disposed within fill chamber 434 for purposes of injecting the incompressible fluid into the system. Adapter 472 includes a fill passageway 474 having an outlet 476 for cooperative engagement with vertical bore 443 of flow passageway 440. An O-ring seal 478 is provided in an annular groove around adapter 472 for sealing engagement with the interior surface of fill chamber 434. Threads are provided around adapter 472 for engagement with fill chamber 434 at 464. Connection means are provided on adapter 472 for connection to appropriate fluid supply means.

In assembling the present invention, it is essential that the upper pressure responsive means 300, forced transmission means 370, and lower pressure responsive means 370 are completely filled with an incompressible fluid and to insure that no air has been trapped in the flow passage extending from upper piston means 350 in upper pressure responsive means 300 to lower piston means 330 in lower pressure responsive means 370. Therefore, during assembly, adapter 472 is inserted into fill chamber 434 with turn-off plug 452 in the open position. An incompressible fluid is passed through adapter 472 and upwardly through conduit 344 until incompressible fluid escapes or overflows through radial fill hole 368. At that time, fill hole 368 is enclosed by an appropriate plug means and turn-off plug 452 is used to close radial bore 442. The remainder of fluid passageway 440 in annular chamber 430 is then filled with fluid and fill plug 462 is inserted. Turn-off plug 452 is then rotated to open radial port 442.

Referring now to both FIGS. 9A, 9B, 9C and 12, pressure equalization means are provided above piston 402. Pressure equalization means includes a fluid passageway extending from equalizing ports 75 to the interior chamber 450 of cylinder 398. An annular groove 482 is provided around body 396 above threads 401. A horizontal bore 484 extends through body 396 to communication with diametrically opposite sides of groove 482. A horizontal blind bore 486 extends from groove 482 and communicates with horizontal bore 484. An axial bore 488 extends from chamber 350 of cylinder 398 upwardly to communicate with horizontal bores 484, 486. Groove 482, horizontal bores 486, 484, and axial bore 488 provide a fluid passageway between lower borehole annulus 32 and chamber 450 of cylinder 398 whereby the pressure in chamber 450 above piston 402 will be the same as the lower annulus pressure. Thus, piston 402 is pressure-balanced.

The sizing of piston 402, the compression in spring 246, and the yield strength of shear pins 296, all permit flexibility in designing the invention for a particular well environment whereby, for example, the temperature of the borehole may be taken into account as it affects the fluid in the fluid system between upper piston means 350 and lower piston means 330.

Figure 16:
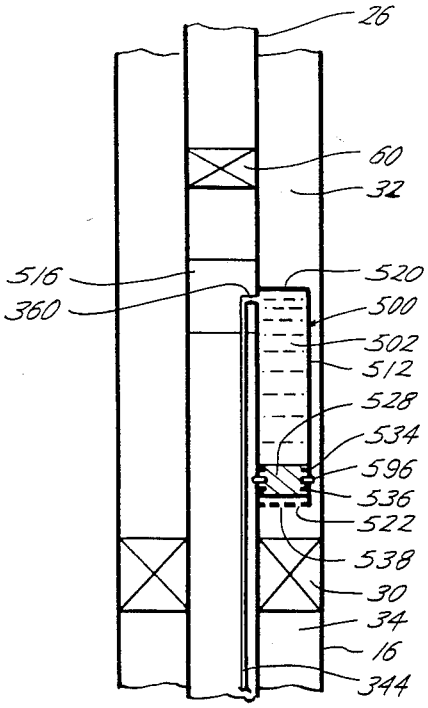
FIG. 16 is a cross-sectional view of another embodiment of the pressure responsive means shown in FIG. 8.
Figure 5:
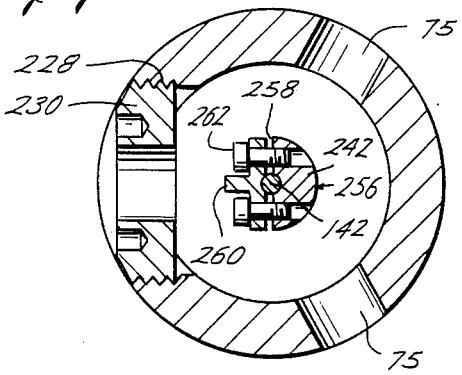
FIG. 5 is a cross-sectional view of the firing mechanism taken at plane 5—5 in FIG. 3.

Another embodiment of the upper pressure responsive means 300 of FIGS. 8A and 8B is illustrated in FIG. 16. Common numerals are used in FIG. 10 to the extent the apparatus is the same as previously described with respect to FIGS. 1, 8A, 8B, 9A, 9B and 9C. Upper pressure responsive means 500, shown in FIG. 10, differs from the previously described upper pressure responsive means 300 in FIGS. 8A and 8B principally in that upper pressure responsive means 500 is not series connected with tubing string 26 but is disposed on the exterior of tubing string 26, i.e. means 300 is integral with string 26 and means 500 is offset.

Upper pressure responsive means 500 includes a cylinder 512 having a piston 528 reciprocally mounted within chamber 502 formed by cylinder 512. Cylinder 512 is closed at its ends by upper and lower closure members 520, 522, respectively. Lower closure member 522 includes pressure communication means in the form of of apertures 538. Apertures 538 face downwardly to avoid any particulate material settling on piston 528. Piston 528 divides chamber 502 into an upper reservoir filled with oil and a lower area subject to the upper annulus pressure due to apertures 538. O-rings 534, 536 housed in annular grooves in piston 538 sealingly engage the interior wall of cylinder 512. Force transmission means 370 in the form of conduit 344 communicates the reservoir of chamber 502 with fluid passageway 440 and chamber 430 of lower pressure responsive means 370 of firing mechanism 380 shown in FIGS. 9A, 9B and 9C. Cylinder 512 is attached by suitable means to a sub 516 series connected in tubing string 26.

Piston 538 is shown releasably connected to cylinder 512 by shear pins 596. Shear pins 596 may be preferred in certain situations since pins 596 insure that piston 538 will not travel upwardly within cylinder 512 until there is a predetermined pressure differential across piston 538 and piston means 376. Shear pins are not essential to upper pressure responsive means 500 but are shown as a possible variation that could also be used with pressure responsive means 300.

Pressure responsive means 500 operates the same as pressure responsive means 300 and means 300,500 differ principally in their location with respect to tubing string 26. Operators often prefer for all tools in the tool string to have drill pipe strength if series connected with other drill pipe. Thus, it is preferred that the pressure responsive means be made out of drill pipe material and series connected rather than be suspended in the upper annulus 32 where it might hang up and be damaged. Further, there are often space limitations in the wellbore annulus prohibiting the location of pressure responsive means 500 in the annulus.

Although not preferred, the pressure responsive means of the present invention may electrically detonate perforating gun 50 rather than use hydraulic actuation. The pressure responsive means for electrical detonation would include electric conduit means for the force transmissions means rather than the cable 142 and conduit 344 shown in FIGS. 2, 8A and 8B, respectively. The pressure responsive means would include a battery pack and two electric leads extending to the gun whereby as the piston in the pressure responsive means traveled upwardly, two electrodes would be engaged and an electric circuit completed to an electrically actuated firing pin to detonate the gun.

While various embodiments of the upper pressure responsive means have been shown and described, modifications thereof can be made by one skilled in the art without departing from the spirit of the invention.

OPERATION OF THE EMBODIMENTS OF FIGS. 8–16

In carrying out the method of the present invention to test formation 14 using the embodiments disclosed in FIGS. 8–16, the tool string as shown in FIG. 1 is assembled and lowered into borehole 10. Although flow ports 73 in perforating nipple 72 permit the well fluids in the wellbore 24 to flow into that portion 56 of flow bore 40 of tubing string 26 extending below valve 60, valve 60 is closed thereby preventing the well fluids from flowing further up the tubing flow bore 40 above valve 60 as indicated at 58.

There will be free access between the wellbore annulus 28 and tubing flow bore 40 above piston means 402 due to flow ports 72 and equalizing ports 75 as the tool string is lowered into the well providing a U-tube effect on piston sleeve 352 and piston means 402. Until packer 30 is set and valve 60 is opened, the pressures on the upper side of piston means 402 and the lower side of piston sleeve 352 (piston sleeve 528 in FIG. 16) will remain substantially the same and prevent any cocking of firing pin 444.

Once perforating gun 50 is adjacent formation 14, a logging tool is run down tubing string 26 to valve 60 to insure that gun 50 is properly positioned with respect to formation 14. At that time, packer 30 is set, dividing borehole annulus 28 into upper annulus 32 and lower annulus 34. Upon setting packer 30, the lower annulus pressure caused by the hydrostatic head in wellbore annulus 28 is trapped beneath packer 30 and valve 60.

To relieve the trapped pressure, pump pressure is applied to the well fluids in upper annulus 32 to open valve 60. The opening of valve 60 relieves the pressure which was trapped in lower annulus 34, and the pressure of tubing flow bore 40 and lower annulus 34 equalize.

Until valve 60 is opened, piston sleeve 352 cannot move upwardly in chamber 340 of upper pressure responsive means 300 since the upper annulus pressure equals the lower annulus pressure on piston means 402 in cylinder 398 of lower pressure responsive means 370. However, once valve 60 is opened, the lower annulus pressure no longer equals the upper annulus pressure and a pressure differential is created across upper piston means 350 and lower piston sleeve 402 (piston sleeve 528 in FIG. 16). Since the pressure in upper annulus 32 will be greater than the pressure in tubing flow bore 40 and lower annulus 34, upper piston sleeve 352 will travel upwardly in chamber 340 (piston sleeve 528 will travel upwardly in chamber 502 with respect to FIG. 16). The upward travel of piston sleeve 352 displaces oil through conduit 344 and into fluid passageway 440 and chamber 430 in lower pressure responsive means 370 of firing mechanism 380. This displacement of oil causes lower piston sleeve 402 in cylinder 398 to travel upwardly displacing the fluid in chamber 450. Piston sleeve 402 moves upwardly in cylinder 398 much like the movement of a hydraulic jack, i.e., slowly and at an even rate.

Where for some reason an instant differential pressure is prematurely caused across upper piston sleeve 352 (piston sleeve 528 in FIG. 16) and piston sleeve 402, chokes 360 and 362 prevent any surge of oil through conduit 344 so as to activate lower pressure responsive means 370. Several seconds are required to pressure up piston sleeve 352 and fire gun 50. Chokes 360, 362 hold back any instant pressure differential until the differential pressure becomes normalized. Since several seconds of steady pressurization are required to pressure up pressure chamber 430, chokes 360, 362 prevent sufficient pressure time to detonate the gun.

If packer 30 should fail after the upper annulus 32 has been pressurized, piston sleeve 402 will merely move back against seal collar 416 and will not permit the firing of gun 50.

As piston sleeve 402 moves upwardly within cylinder 398, firing pin 244 travels upwardly with shaft 242 thereby compressing spring 246 between shoulder 264 and face 276. The force required to continue such upward movement increases with the upward travel of piston sleeve 402. Since the compression of spring 246 requires increased force for additional compression. Once the force required to further compress spring 246 exceeds the yield strength of shear pins 296, pins 296 will shear and sever shaft 242 at connection 250.

Upon severing shaft 242, spring 246 propels firing pin 244 on shaft 242 downwardly impacting initiator 220 whereupon the shaped charges 52 of gun 50 are detonated and the casing 16 perforated.

As in the embodiment of FIGS. 2–6, if the operator should decide not to perforate and complete the well, the firing mechanism 80 cannot be cocked so as not to fire the gun as the gun 50 is removed from the borehole. Piston sleeve 402 is never mechanically held in the cocked position. Further, partial travel of piston sleeve 402 in cylinder 398 will not permit pins 296 to shear and detonate gun 50.

Referring now to the description of pressure responsive means 500 and shear pins 596 shown in FIG. 16, shear pins 596 pinning piston sleeve 528 within cylinder 502 may be desirable such as for detection purposes or for packer testing as has been previously discussed with respect to FIGS. 2–6.

Further, the embodiments of FIGS. 8–16 may also be used with the methods described with reference to FIG. 7. The only principal difference is that the embodiment of FIGS. 8–16 include an upper and lower responsive means with the force transmission means being disposed therebetween. The upper pressure responsive means 300, 500 are disposed above packer 30 and lower pressure responsive means 370 is disposed adjacent firing mechanism 380. Thus, the pressure differential is applied across the pistons of both the upper and lower pressure responsive means.

Although the embodiments described with reference to FIGS. 2–6 and FIGS. 8–16 disclose pressure balancing the interior of firing mechanisms 80, 380 with the lower borehole annulus pressure, that need not be the case. For example, the interior of firing mechanisms 80, 380 may be at a lower pressure such as atmospheric pressure. In such a construction, equalizing ports 201, 203 in housing 200 would be eliminated and shaft 242 would be sealed with the interior of housing 200. Shaft 242 is already sealed with housing 200 in the embodiment of FIGS. 8–16 by seals 413, 420 shown in FIG. 9B. With respect to the embodiment of FIGS. 2–6, sealing elements would be housed within the coaxial bore of retainer ring 252 and around retainer ring 252 to seal with shaft 242 and housing 200 respectively and prevent fluids from leaking into interior bore 236. Flow ports 268 would no longer be necessary and connection 243 would be replaced with a shear pin connection such as that disclosed in FIG. 9 of U.S. Patent application, Ser. No. 412,930 filed Aug. 30, 1982. In another example, the lower portion of bore 236 of housing 200 may be sealed off from the upper portion of bore 236. Seals are disposed on the inner peripheray of flange 264 of member 248 for sealing engagement with shaft 242 and seals are disposed on the outer periphery of member 248 for sealing engagement with the interior of housing 200. Equalizing ports 203 and flow ports 268 are eliminated. In this example, the lower portion of bore 236 is at a lower pressure, such as atmospheric, than the lower borehole annulus pressure. In these examples, the firing pin 244 is housed in a lower pressure or atmospheric pressure chamber whereby upon moving shaft 242 upwardly and shearing shaft 242, firing pin 244 snaps downwardly by means of spring 246 with a greater action than with a pressure balanced firing pin since there is no fluid in chamber 219 to resist the downward movement of firing pin 244.

These and various other objects and advantages of the present invention will become readily apparent to those skilled in the art upon reading the detailed description and claims and by referring to the accompanying drawings. The above objects are attained in accordance with the present invention by the provision of the methods of completing and testing highly unconsolidated formations for use with apparatus fabricated in a manner substantially as described in the above abstract and summary.

While a preferred embodiment of the invention has been shown and described, modifications thereof can be made by one skilled in the art without departing from the spirit of the invention.

We claim:

1. An actuator apparatus for a perforating gun suspended on a pipe string below a packer in a well, the packer separating an upper well annulus from a lower portion of the well, comprising:

a first tubular body adapted for suspension on the pipe string above the packer;

the first tubular body having a first opening communicating with the upper well annulus;

a piston movably disposed within said first tubular body and movable within said first tubular body upon the creation of a pressure differential across said piston;

one side of the piston being subjected to fluid pressures in the upper well annulus by means of said first opening and another side of the piston being subjected to fluid pressures at the interior of said body;

a second tubular body attached to the perforating gun;

a firing pin movably disposed in said second tubular body and adapted for engagement with the perforating gun to detonate the gun;

a solid member extending between said first and second tubular bodies and connected to said piston and said firing pin for moving said firing pin to a firing position; and said piston acting on said solid member to move said firing pin to said firing position in response to the pressure differential.

2. The actuator apparatus of claim 1 wherein said solid member includes a cable extending from said piston member to said firing pin.

3. The actuator apparatus of claim 1 further including apertures in said second tubular body and firing pin to equalize the pressure around said firing pin with the pressure at the exterior of said second tubular body.

4. The actuator apparatus of claim 1 wherein said solid member is housed within the pipe string.

5. The actuator apparatus of claim 1 wherein said first tubular body includes an annular chamber; said piston being movably disposed within said annular chamber.

6. The actuator apparatus of claim 5 further including seal means disposed on said piston for sealingly engaging the walls forming said annular chamber.

7. The actuator apparatus of claim 1 further including compressible means engaging said second tubular body and biasing said firing pin towards the perforating gun.

8. The actuator apparatus of claim 7 wherein said compressible means is housed within tubular means disposed within said second tubular body.

9. The actuator apparatus of claim 1 further including shear means for releasably holding said piston in a fixed position until a predetermined pressure differential is effected across said piston.

10. The actuator apparatus of claim 1 further including mounting means for mounting one end of said solid member to said piston.

11. The actuator apparatus of claim 11 wherein said mounting means includes a ring slidably disposed within said first tubular body and in engagement with said piston, said ring having attachment means for attaching said member to said ring.

12. The actuator apparatus of claim 1 further including biasing means for biasing said piston in one direction.

13. The actuator apparatus of claim 1 wherein said first tubular body includes a mandrel telescopingly receiving a sleeve to form an annular chamber for housing said piston.

14. The actuator apparatus of claim 1 further including releasable means for releasing said firing pin from said solid member, said releasable means including a shaft extending from said solid member to said firing pin and shear means for releasably connecting said shaft to said firing pin whereby said shear means shears upon the application of a predetermined force on said firing pin.

15. The actuator apparatus of claim 14 further including biasing means on said shaft for biasing said firing pin towards the perforating gun whereby as said piston moves said solid member causes said firing pin to move away from the perforating gun until the force of said biasing means actuates said releasable means to release the firing pin and fire the perforating gun.

16. The actuator apparatus of claim 1 further including a releasable means having a first member attached to said solid member and a second member attached to said firing pin, said first and second members having an internal pressure chamber and being sealed together whereby said first and second members are connected when the pressure external to said first and second members is greater than the pressure within said internal pressure chamber.

17. An actuator apparatus for a perforating gun suspended on a pipe string below a packer in a well, comprising:

a first tubular body series connected in the pipe string above the packer;

a first piston member disposed on said first tubular body and movable on said body upon the creation of a pressure differential across said first piston member;

a second tubular body series connected in the pipe string above the perforating gun;

the pipe string including a portion extending between the first and second tubular bodies;

a firing mechanism disposed in said second tubular body having a firing pin for engagement with the perforating gun to detonate the gun;

a pressure transmitting member extending from said first piston member through said first tubular body, through that portion of the pipe string between said first and second tubular members, and into said second tubular member to said firing mechanism for moving said firing mechanism to a firing position;

means for filling said pressure transmitting member with an incompressible fluid and excluding compressible fluid; and said first piston member displacing said incompressible fluid in said pressure transmitting member to hydraulically move said firing mechanism to said firing position in response to the pressure differential.

18. The actuator apparatus of claim 17 wherein said pressure transmitting member includes a fluid conduit extending from said first piston member to said firing mechanism.

19. The actuator apparatus of claim 17 further including apertures in said second tubular body, firing mechanism, and firing pin to equalize the pressure around said firing pin with the pressure at the exterior of said second tubular body.

20. The actuator apparatus of claim 17 wherein said first tubular body includes an annular chamber having a first opening communicating with the exterior of said body and a second opening communicating with the interior of said body; said first piston member being movably disposed within said annular chamber such that one side of said first piston member is subjected to fluid pressures at the exterior of said body by means of said first opening and another side of said first piston member is subjected to the fluid in said pressure transmitting member by means of said second opening.

21. The actuator apparatus of claim 20 wherein said first opening is in fluid communication with the exterior of the pipe string above the packer and said second opening is in fluid communication with the interior of the pipe string.

22. The actuator apparatus of claim 20 further including connecting means for connecting one end of said pressure transmitting member to said second opening.

23. The actuator apparatus of claim 22 wherein said connecting means includes a tubular member disposed within said first tubular body and in alignment with said second opening, said tubular member having attachment means for attaching said pressure transmitting member to said tubular member.

24. The actuator apparatus of claim 17 further including seal means disposed on said first piston member for sealingly engaging the walls forming said first annular chamber.

25. The actuator apparatus of claim 17 further including compressible means engaging said second tubular body and biasing said firing pin towards the perforating gun.

26. The actuator apparatus of claim 25 wherein said compressible means is housed within tubular means disposed within said second tubular body.

27. The actuator apparatus of claim 17 further including shear means for releasably holding said first piston member in a fixed position until a predetermined pressure is effected on said one side of said first piston member.

28. The actuator apparatus of claim 17 wherein said first tubular body includes a mandrel telescopingly receiving a sleeve to form an annular chamber for housing said first piston.

29. The actuator apparatus of claim 17 further including releasable means for releasing said firing pin from said firing mechanism, said releasable means having a second piston member reciprocably disposed in a cylinder of said firing mechanism, said cylinder being in fluid communication with said pressure transmitting member and having one end attached to said firing pin.

30. The actuator apparatus of claim 29 wherein said releasable means further includes shear means for releasably connecting said second piston member to said firing pin whereby said shear means shears upon the application of a predetermined force on said firing pin.

31. The actuator apparatus of claim 29 further including biasing means on said second piston member for biasing said firing pin towards the perforating gun whereby as said first piston member moves, said pressure transmitting means displaces fluid into said cylinder causing said second piston member and firing pin to move away from the perforating gun until the force of said biasing means of said firing pin shears said shear means and said firing pin moves into engagement with the perforating gun due to said biasing means to fire the perforating gun.

32. The actuator apparatus of claim 29 wherein said second piston member includes a first member disposed in said cylinder and a second member attached to said firing pin, said first and second members having an internal pressure chamber and being sealed together whereby said first and second members are connected when the pressure external to said second member is greater than the pressure within said internal pressure chamber.

* * * * *

UNITED STATES PATENT AND TRADEMARK OFFICE

CERTIFICATE OF CORRECTION

PATENT NO. : 4,564,076

DATED : January 14, 1986

INVENTOR(S) : Roy R. Vann and Emmet F. Brieger

It is certified that error appears in the above-identified patent and that said Letters Patent is hereby corrected as shown below:

In column 4, line 6, delete the word [im] and insert therefor --in--.
In column 8, line 48, delete the word [incudes] and insert therefor --includes--.
In column 8, line 51, delete the numeral [224] and insert therefor--244--.
In column 11, line 50, delete the word [blow] and insert therefor --flow--.
In column 25, line 44, following the word "claim" delete the numeral [11] and insert therefor --10--.

Signed and Sealed this

Twenty-fifth Day of November, 1986

*Attest:*

DONALD J. QUIGG

*Attesting Officer* *Commissioner of Patents and Trademarks*